US007946240B2

(12) United States Patent
Besenzoni

(10) Patent No.: US 7,946,240 B2
(45) Date of Patent: May 24, 2011

(54) GROUP FOR OPERATION FENDER ELEMENTS SUITABLE TO PROTECT A BOAT DURING MOVEMENT AND MOORING

(76) Inventor: Giorgio Besenzoni, Paratico (IT)

( * ) Notice: Subject to any disclaimer, the term of this patent is extended or adjusted under 35 U.S.C. 154(b) by 137 days.

(21) Appl. No.: 12/152,410

(22) Filed: May 14, 2008

(65) Prior Publication Data

US 2008/0295759 A1 Dec. 4, 2008

(30) Foreign Application Priority Data

May 29, 2007 (IT) ..... VI2007A0155

(51) Int. Cl.
*B63B 59/02* (2006.01)

(52) U.S. Cl. ..... 114/219

(58) Field of Classification Search ..... 114/219
See application file for complete search history.

(56) References Cited

U.S. PATENT DOCUMENTS 3,109,404 A * 11/1963 Hartel ..... 114/219
3,744,445 A * 7/1973 Malenka ..... 114/219
4,738,566 A * 4/1988 Marthinsen ..... 405/217
4,883,013 A * 11/1989 Lin ..... 114/219
5,758,583 A * 6/1998 Lohr ..... 105/72.2

* cited by examiner

*Primary Examiner* — Stephen Avila
(74) *Attorney, Agent, or Firm* — Hedman & Costigan, P.C.; James V. Costigan

(57) ABSTRACT

An assembly (1; 200; 300; 400; 500; 600) for operating fender elements (P) suitable to protect a boat during the movement and/or mooring including articulation means (2; 201; 301; 401; 501; 601) which are connected to the fender element (P) and moving means (3; 202; 302; 402; 502; 602), suitable to be coupled with the boat, operatively connected to the articulation means (2; 201; 301; 401; 501; 601) for moving them between at least a working position in which they dispose the fender element (P) at least partly laterally protruding from the boat, and at least a rest position in which they dispose the fender element (P) receding with respect to the boat.

51 Claims, 19 Drawing Sheets

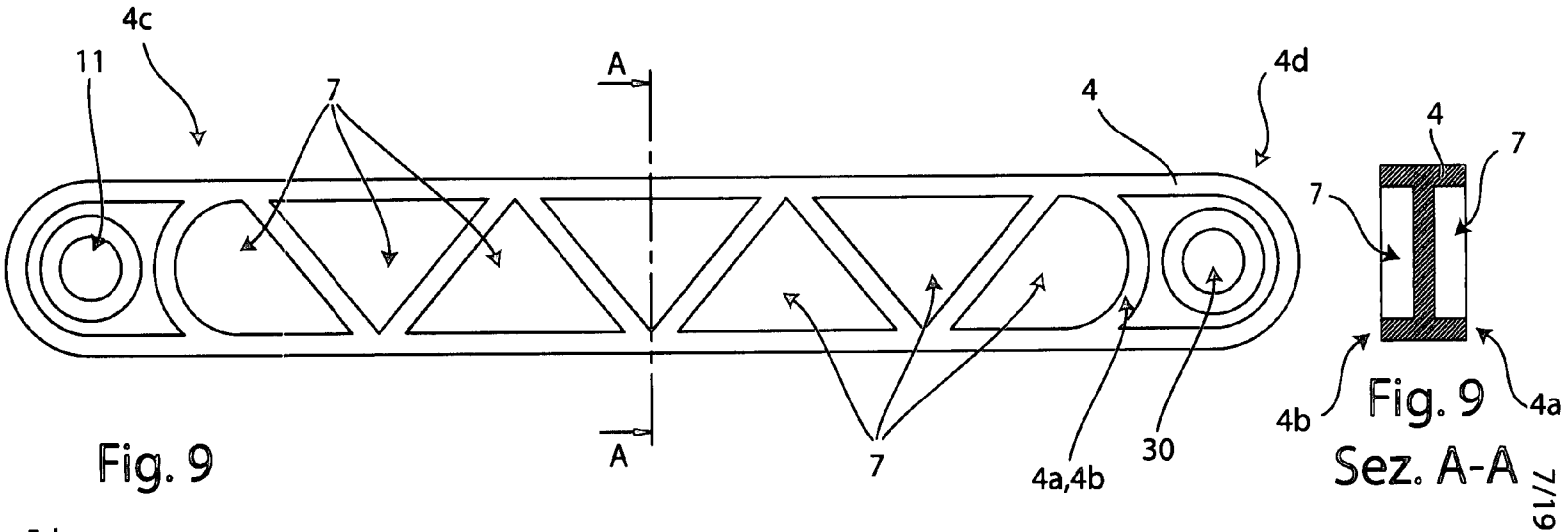
Fig. 9
Sez. A-A
Fig. 9
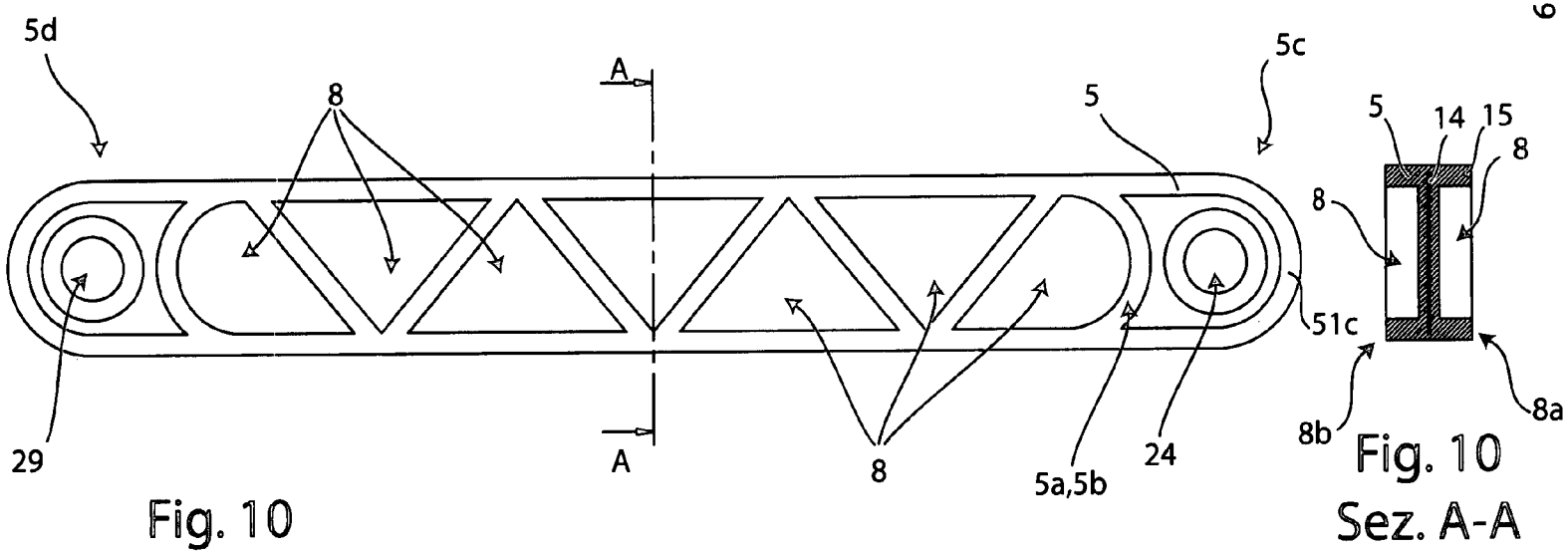
Fig. 10
Sez. A-A
Fig. 10

GROUP FOR OPERATION FENDER ELEMENTS SUITABLE TO PROTECT A BOAT DURING MOVEMENT AND MOORING

CROSS-REFERENCE TO RELATED APPLICATIONS

None

STATEMENT REGARDING FEDERALLY SPONSORED RESEARCH OR DEVELOPMENT

None

THE NAMES OF THE PARTIES TO A JOINT RESEARCH AGREEMENT

None

REFERENCE TO A SEQUENCE LISTING

None

BACKGROUND OF THE INVENTION (1) Field of the Invention

This invention regards to an assembly for operating fender elements suitable to protect a boat during the movement or stop.

(2) Description of Related Art

As known, the placing of a craft, such as a ship, a boat or a hull, in the position of docking or mooring, is a manoeuvre rather laborious and however not always easy, especially if in the stop area other crafts or various structures, of which the moving vehicles must come up by the side, are present.

Just think when a boat is docking to the pier or the wharf of a port or, besides, when it must moor near other vessels already at stop, particularly in a specific space between two of them.

The difficulty is primarily determined by the combination of two reasons: the unstable nature of the surface on which the boat moves, which is the water, and the sense of march with which these means are moved in such occasions, almost always the reverse, in order to obtain a replacement on site as correct and efficient as possible.

Therefore, despite the attention taken by the driver in manoeuvring, the moving boat accidentally hits against adjacent bodies, with the obvious problems which this causes for the structural integrity of the one as well as of the others.

Furthermore, in order to limit the negative possibilities just said, the driver carries out slowly or is forced to repeat several times the manoeuvres which, thus, require longer time to be completed and which, moreover, succeed only in sporadic cases or minimally.

The problems associated with the ruinous effects of the accidental collisions are also found in case the boat is completely motionless, already moored or docked.

As a matter of fact, for this situation various types of equipments and components, mostly fenders of the inflatable type or containing spongy or rubber material, which eliminate or greatly limit the damaging effects resulting from the collisions between boats, are currently available on the market. Such elements, sometimes protruding from the wall of the ship sometimes fixed directly to the pier or wharf, lend themselves to offer to the boat a protection against the accidental impacts only in static conditions, namely when it is moored or docked, being not suitable for situations where the same ship is still in motion.

However, the fender elements of the known type have some recognised drawbacks.

The main drawback of the known art comes from the fact that the placing of these protection elements protruding laterally from the boat is somewhat laborious, articulate and extended over time, whether carried out manually by an operator or automatically. A second drawback of the known technique consists in a certain instability of the protection elements while they are still hanging sideways to protect the boat against accidental impacts.

The present invention intends to remedy to the drawbacks of the prior art just listed.

In particular, the primary aim of the invention is to provide an assembly for operating fender elements suitable to protect a boat which allows to reduce, compared to the known equivalent technique, the time needed to place such fender elements in effective and efficient protection of the boat.

It is another aim of the present invention to offer to fender elements of a boat, in conditions of use, a greater stability with respect of known equivalent elements.

A last but not least aim of the invention is to realize an assembly for operating fender elements suitable to protect a boat which lends itself to be in place on use on the boat in any its condition, both during the movement and during the mooring or docking.

BRIEF SUMMARY OF THE INVENTION

The aforesaid aims are achieved through an assembly for operating fender elements suitable to protect a boat during the movement and/or mooring as the attached claim 1, to which they refer for the sake of brevity.

Other features of detail of the operating assembly of the invention are reported in the corresponding dependent claims.

Advantageously, the operating assembly allows to place outside of the boat fender elements of protection against accidental collisions more quickly and with less laborious manoeuvres with respect to the known art.

Still advantageously, the operating assembly according to the invention gives to the fender elements of the boats greater stability in use conditions.

Equally advantageously, the invention enables the use of the same fender elements in conditions both of movement and mooring or docking of the boat.

In an advantageous manner, in addition, the operating assembly is embedded in a space realized in the wall of the boat in which it remains when not used.

In this situation, the space of the boat can conveniently be closed by a shutter connected to a linear actuator of the known type, for example hydraulic, suitable to be operated for automatically move the shutter from the closed position to the open position of the space and vice versa, allowing conversely the exit and the return of the operating assembly with respect to the boat.

BRIEF DESCRIPTION OF THE SEVERAL VIEW OF THE DRAWINGS

The aforesaid aims and advantages will be more evident from the description of preferred embodiments of the invention, given by way of illustrative but not limiting example with reference to the attached drawings where:

FIG. 9 is a side view of an enlarged particular of the assembly of the invention;

Figure 1:
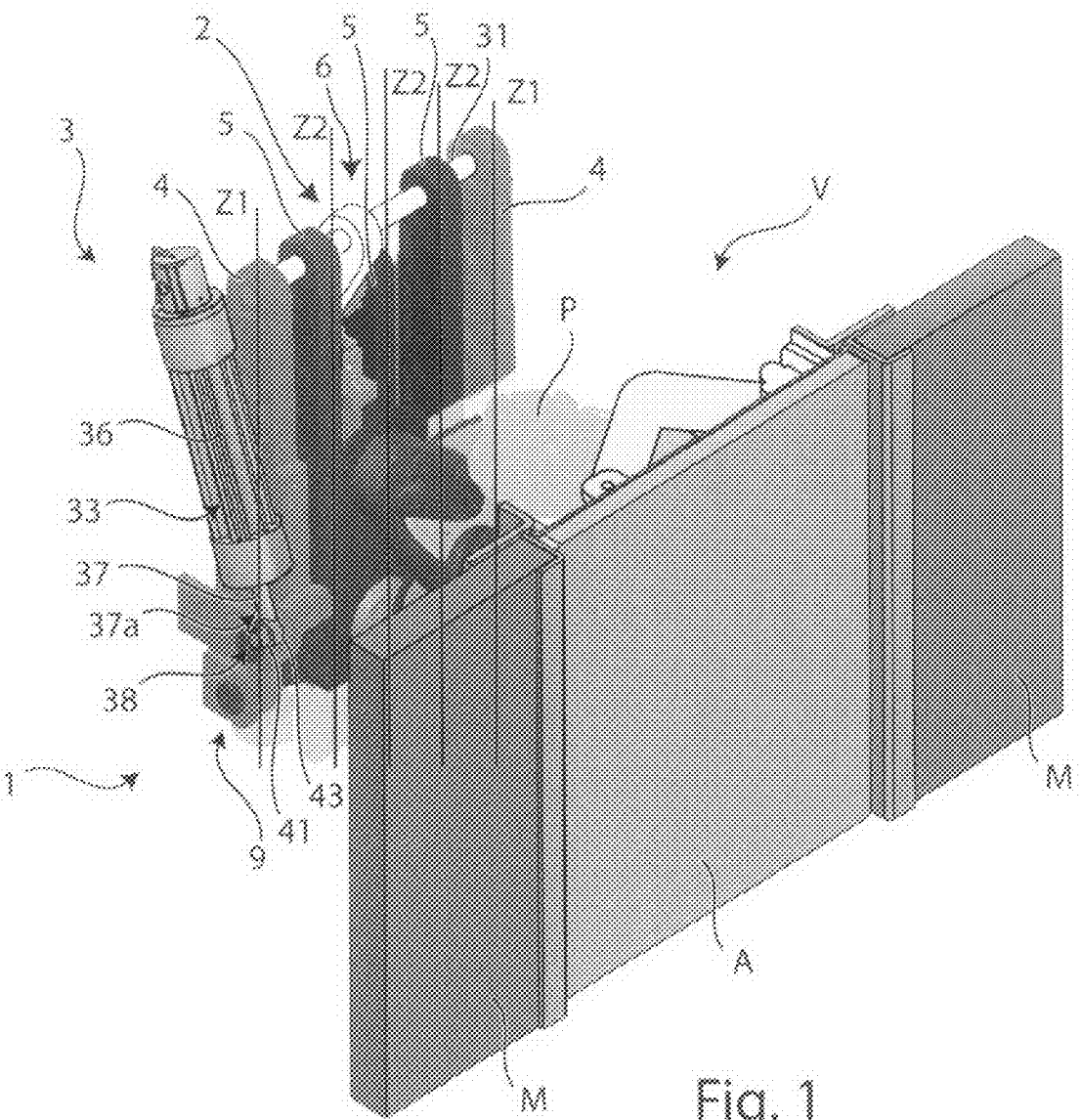
FIG. 1 is an applicative perspective view of the assembly of the invention in the rest position.
Figures 11, 12, 13:
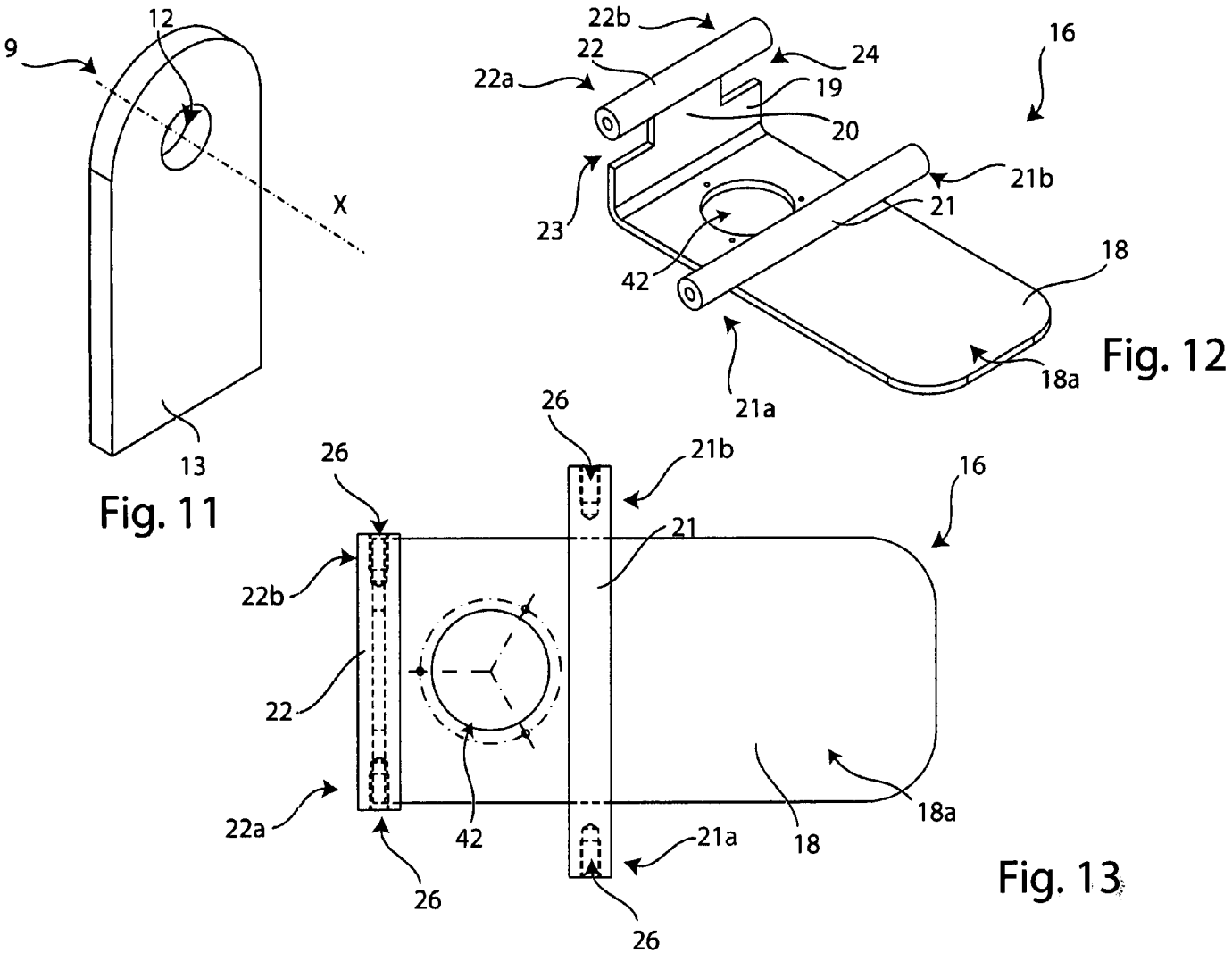
Figure 15:
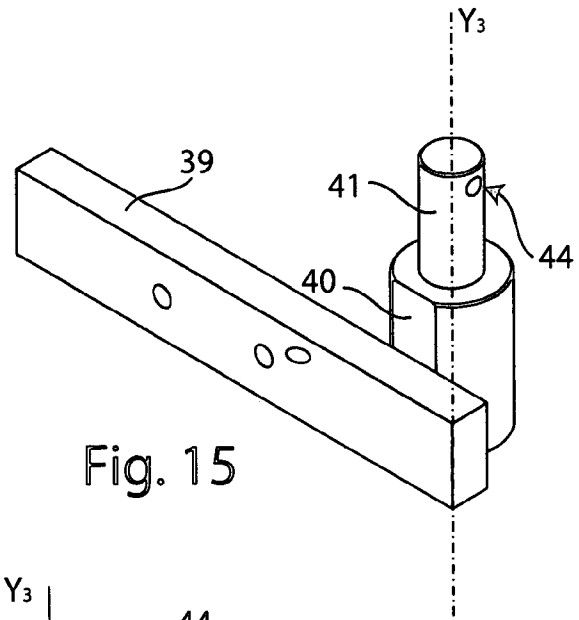
Figure 16:
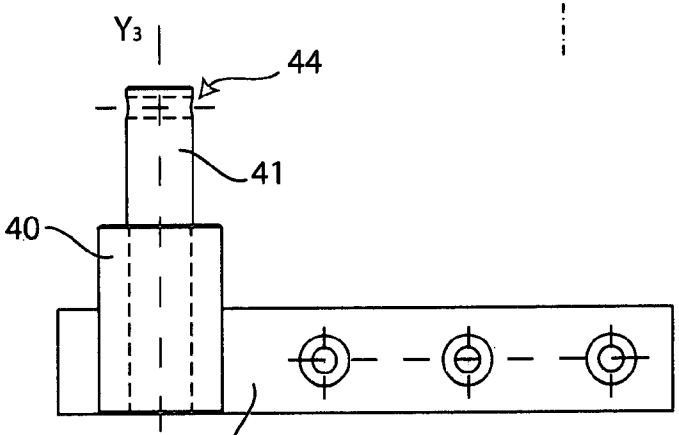
Figure 14:
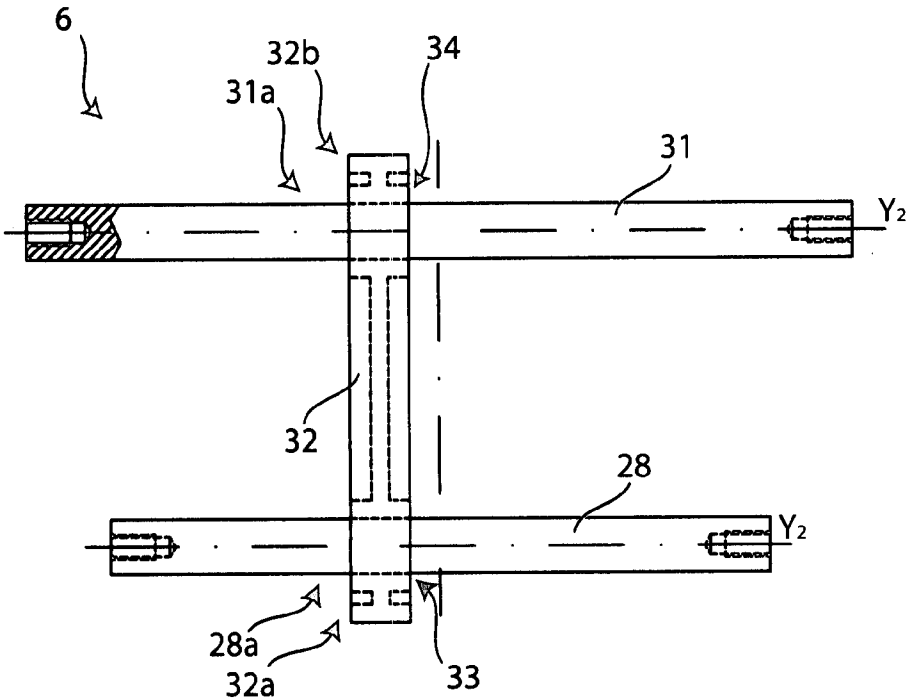
Figure 18:
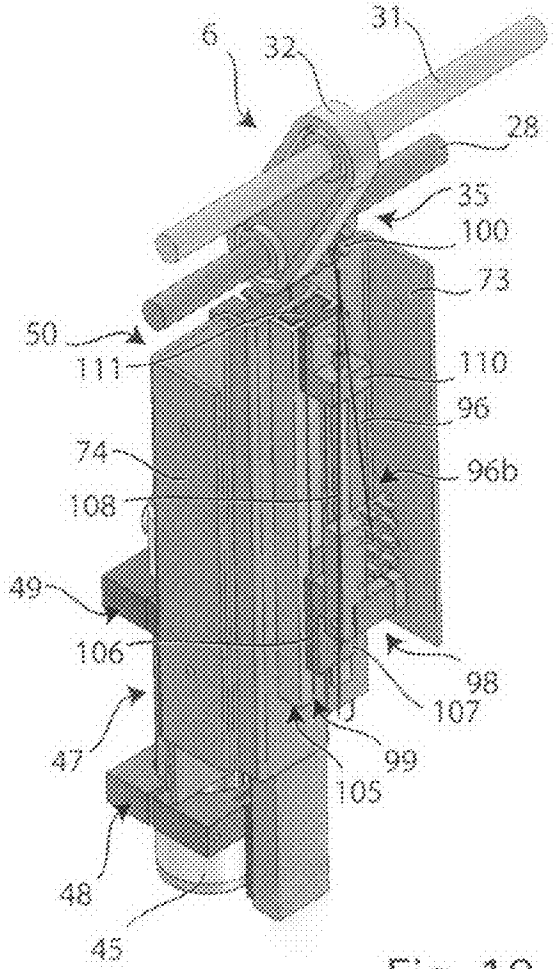
Figure 17:
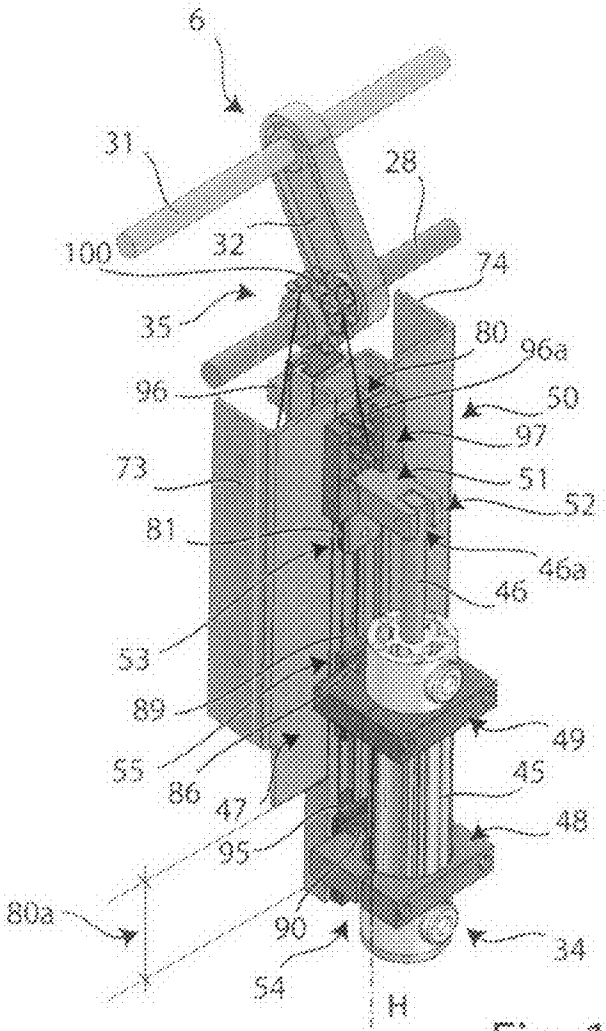
Figure 21:
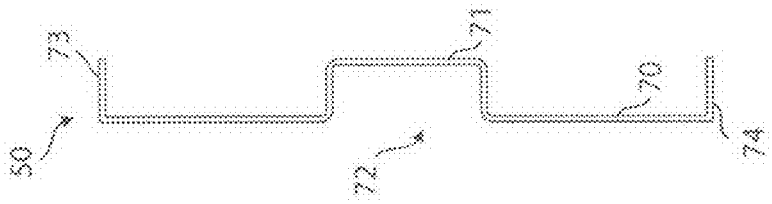
Figure 20:
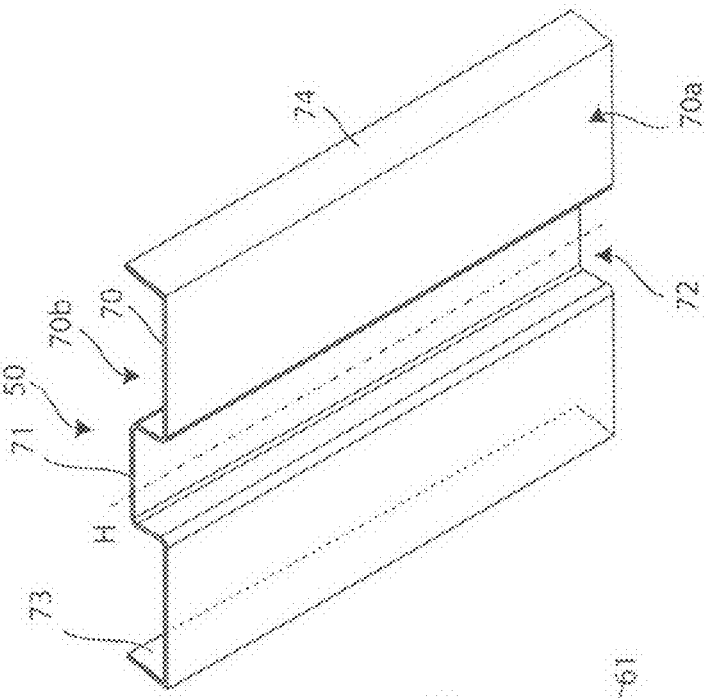
Figure 19:
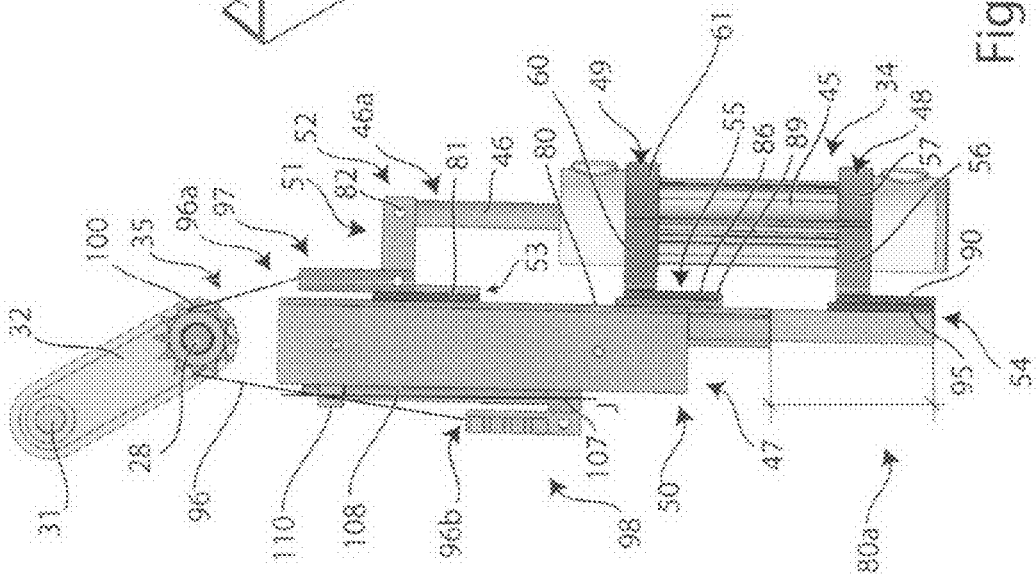
Figure 22:
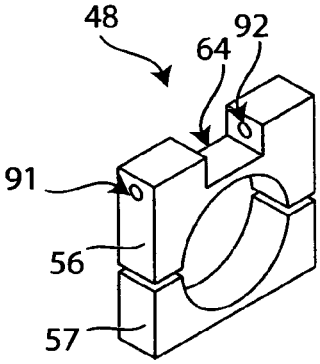
Figure 23:
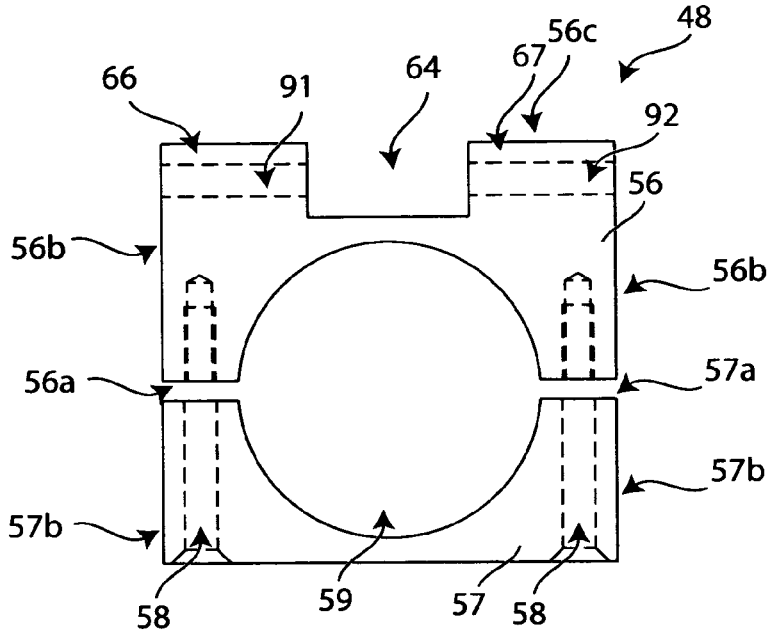
Figure 24:
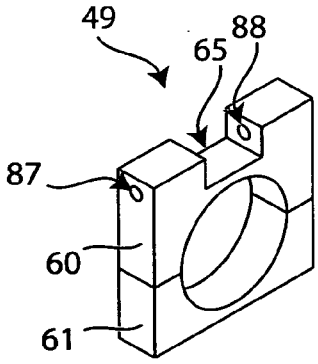
Figure 25:
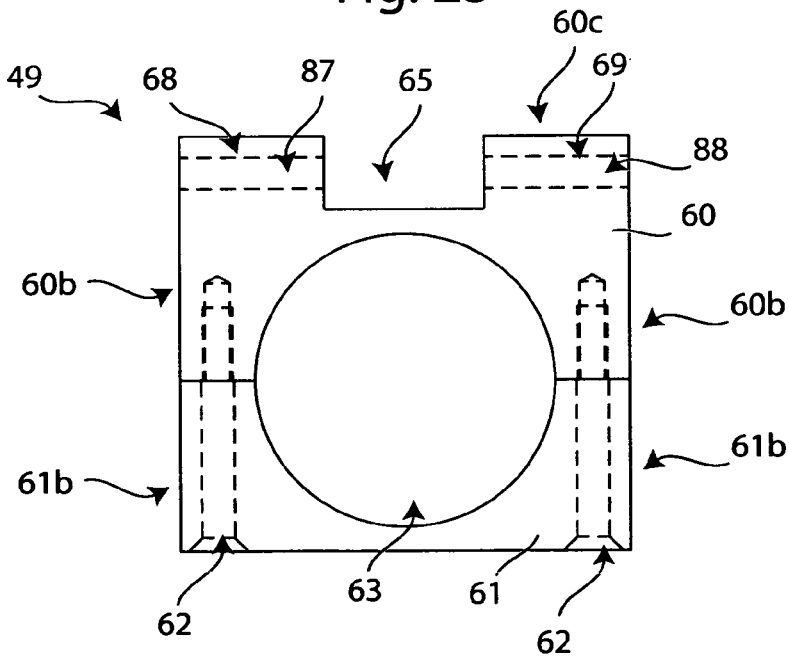
Figure 26:
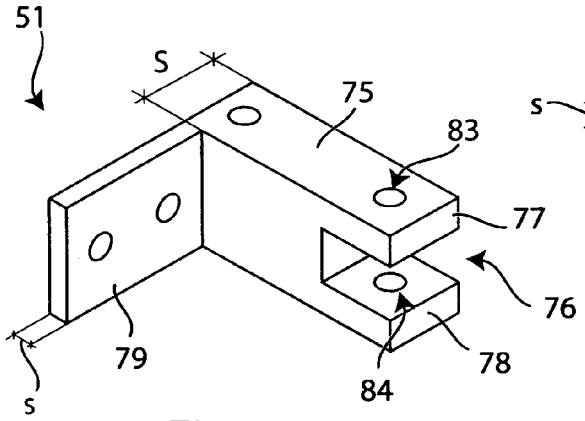
Figure 27:
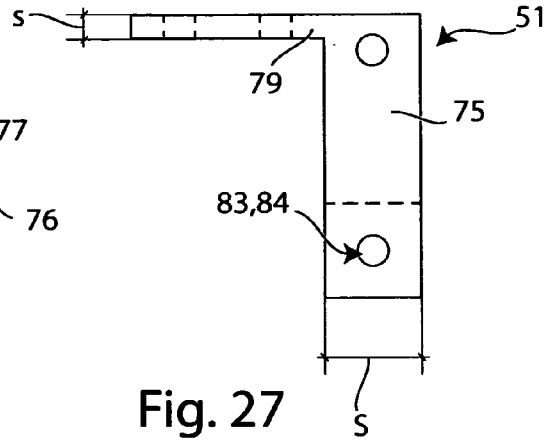
Figure 38:
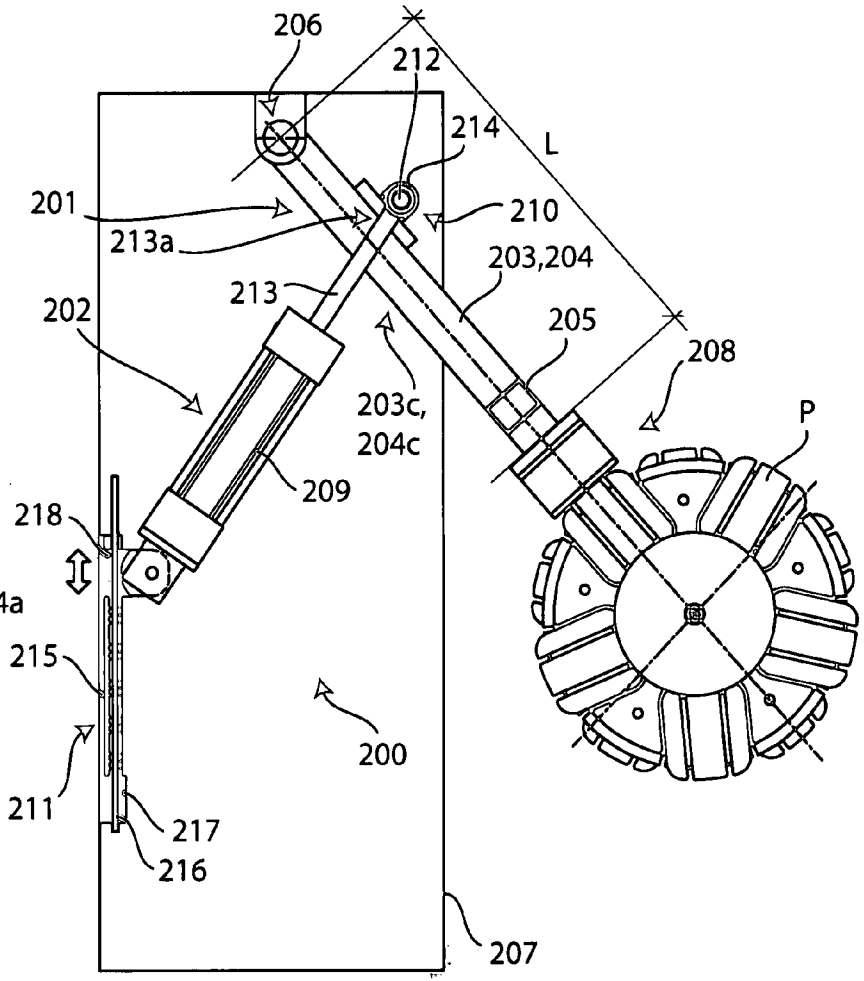
Figure 37:
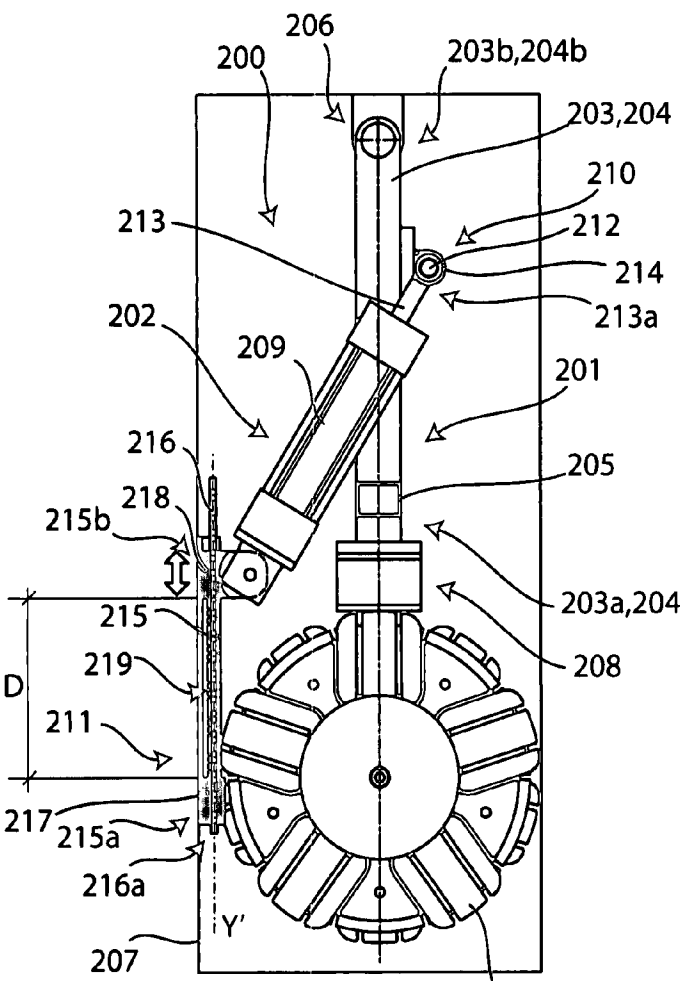
Figure 39:
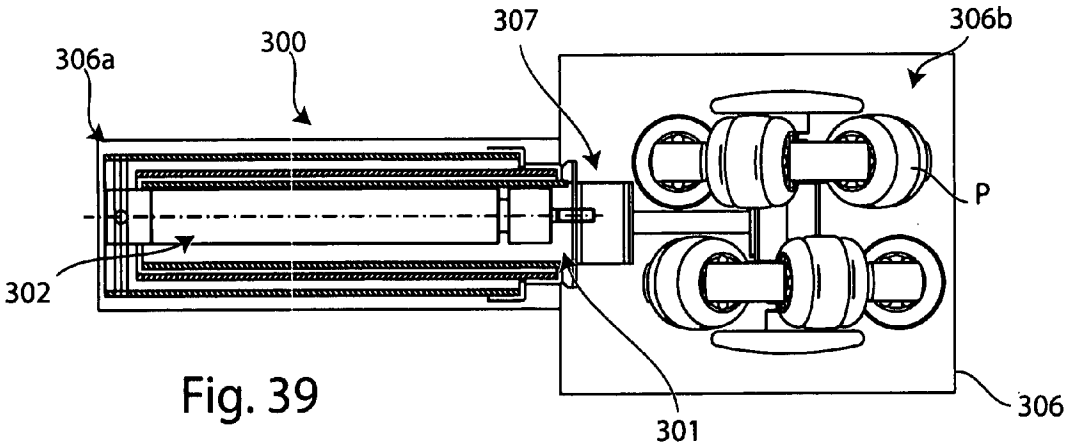
Figure 40:
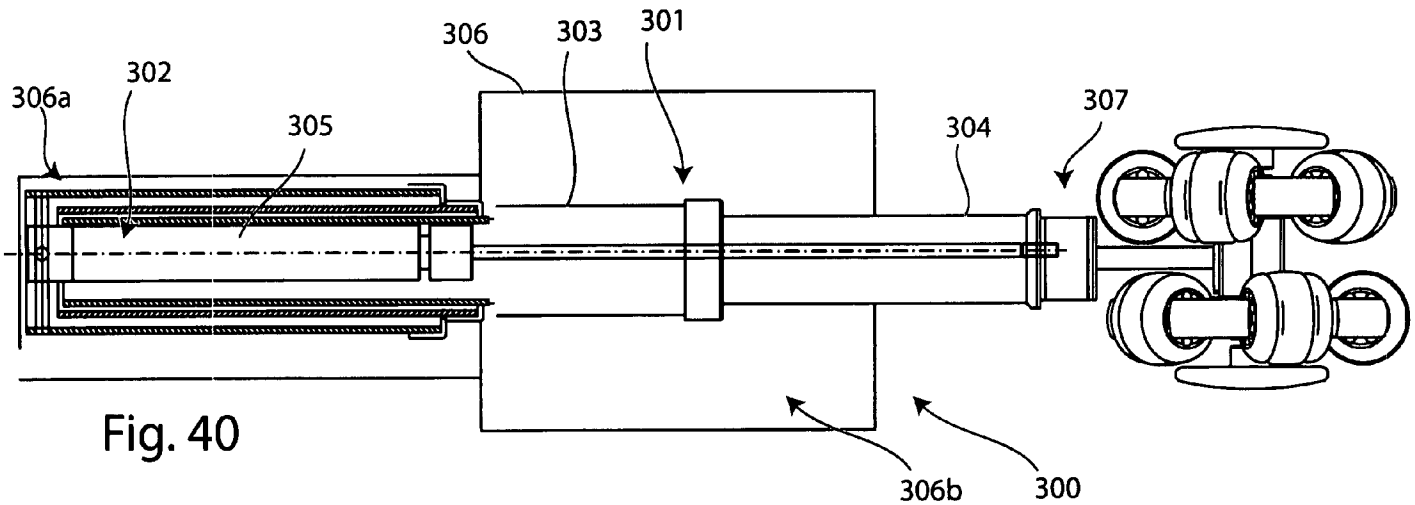
Figure 41:
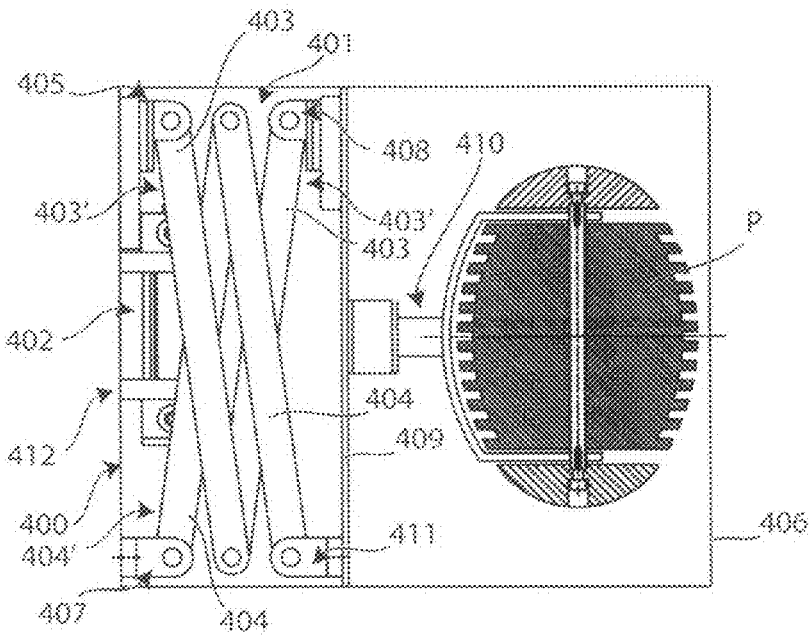
Figure 42:
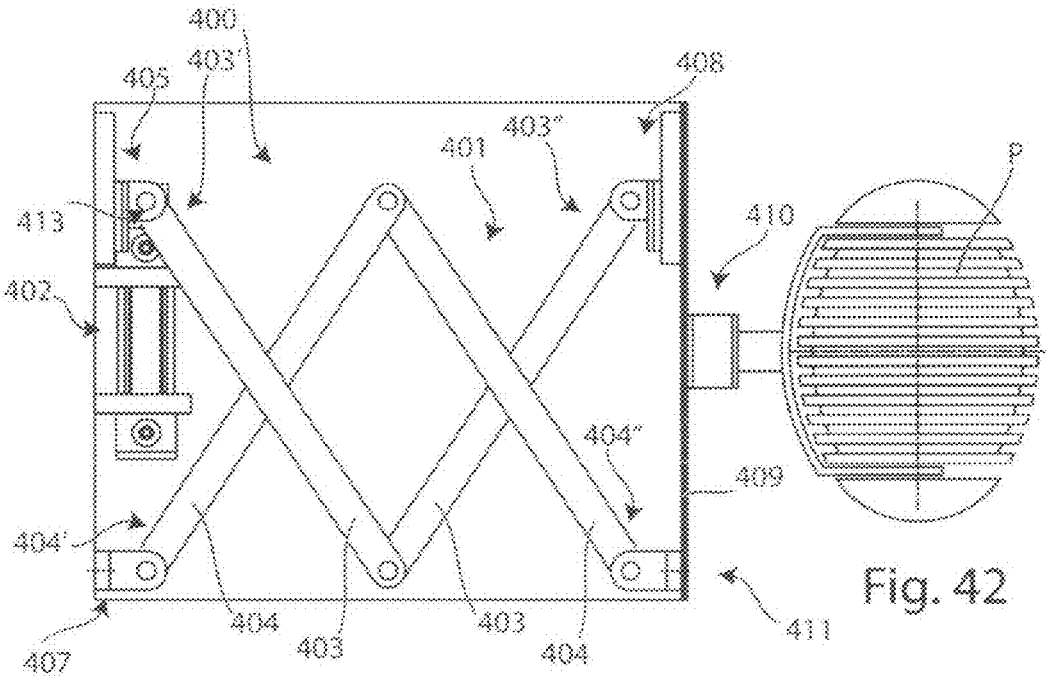
Figure 43:
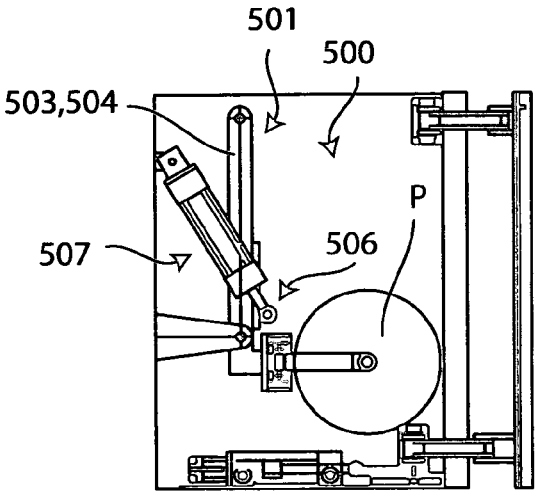
Figure 44:
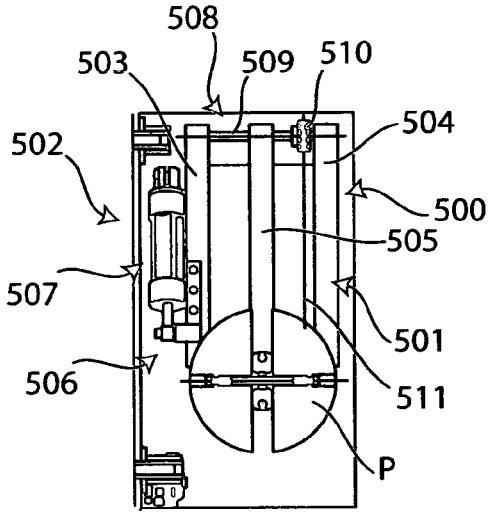
Figure 45:
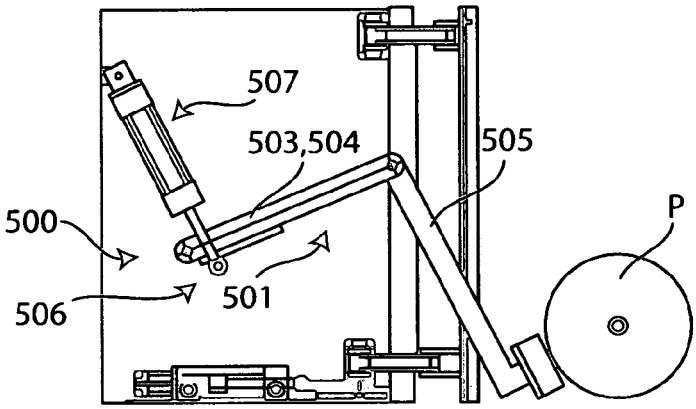
Figure 46:
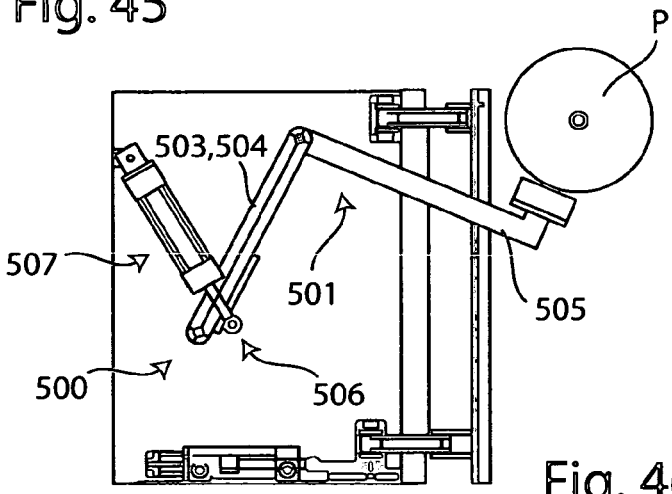
Figure 47:
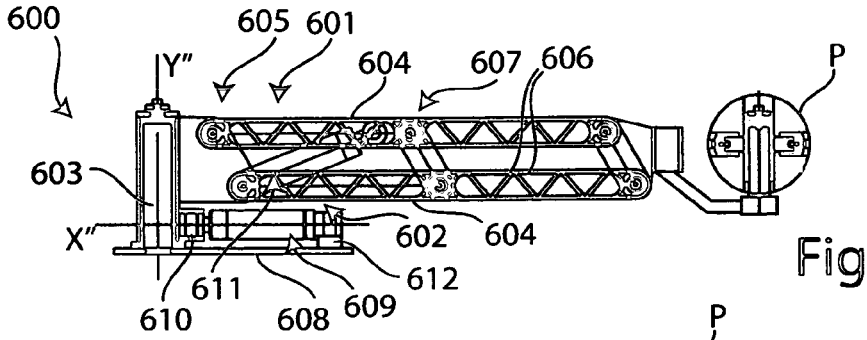
Figure 48:
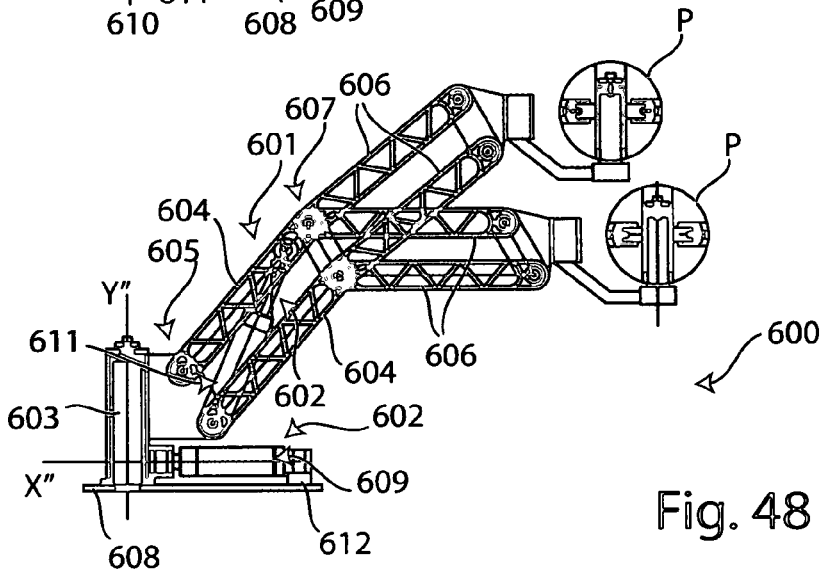
Figure 49:
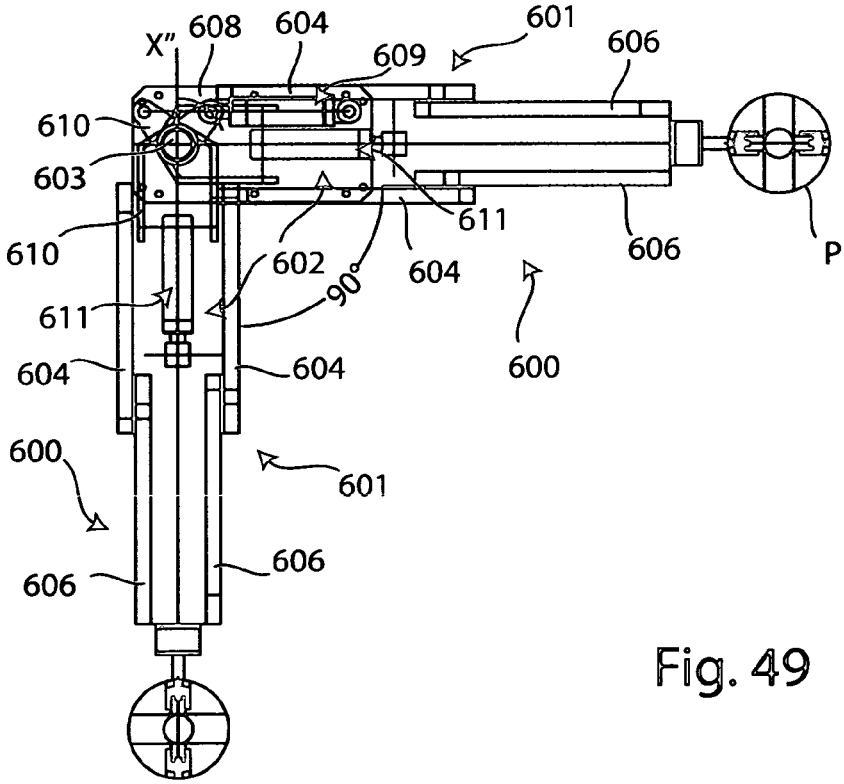

FIG. 9*a* is a view of FIG. 9 according to the cutting plane A-A;

FIG. 10 is a side view of a further enlarged particular of the assembly of the invention;

FIG. 10*a* is a view of FIG. 10 according to the cutting plane A-A;

FIG. 11 is a perspective view of another enlarged particular of the assembly of the invention;

FIG. 12 is a perspective view of another enlarged particular of the assembly of the invention;

FIG. 13 is the plan view of FIG. 12;

FIG. 14 is a reduced and partly cutaway side view of a constructive part of the assembly of the invention;

FIG. 15 is a perspective view of another enlarged particular of the assembly of the invention;

FIG. 16 is a side view of FIG. 15;

FIG. 17 is a simplified perspective view of the assembly of FIG. 1;

FIG. 18 is the opposed view of FIG. 17;

FIG. 19 is a side view of FIG. 17;

FIG. 20 is a perspective view of another enlarged particular of the assembly of the invention;

FIG. 21 is a side view of FIG. 20;

FIG. 22 is a perspective view of another enlarged particular of the assembly of the invention;

FIG. 23 is a side view of FIG. 22;

FIG. 24 is a perspective view of another enlarged particular of the assembly of the invention;

FIG. 25 is a side view of FIG. 24;

FIG. 26 is a perspective view of another enlarged particular of the assembly of the invention;

FIG. 27 is a side view of FIG. 26;

FIGS. 28-36 are perspective views of respective and different enlarged particulars of the assembly of the invention;

FIGS. 37, 38 are partly cutaway side views of a first executive variant of the assembly of the invention, respectively in rest and working position;

FIGS. 39, 40 are partly cutaway side views of a second executive variant of the assembly of the invention, respectively in rest and working position;

FIGS. 41, 42 are side views of a third executive variant of the assembly of the invention, respectively in rest and working position;

FIG. 43 is a side view of a fourth executive variant of the assembly of the invention in the rest position;

FIG. 44 is the plan view of FIG. 43;

FIGS. 45, 46 are side views of the assembly of FIG. 43 in two distinct working positions;

FIGS. 47, 48 are side views of a fifth executive variant of the assembly of the invention, respectively in rest and working position;

FIG. 49 is the composite plan view of FIGS. 47 and 48.

DETAILED DESCRIPTION OF THE INVENTION

The operating assembly is shown in FIGS. 1-4, where it is indicated with 1 as a whole, in various operative situations one consecutive to the other during use.

In particular, it lends itself for the automatic manoeuvre of a fender element P suitable to protect a boat, not shown, during movement, docking, mooring and/or, more in general, berthing manoeuvre to a stop area.

Figure 4:
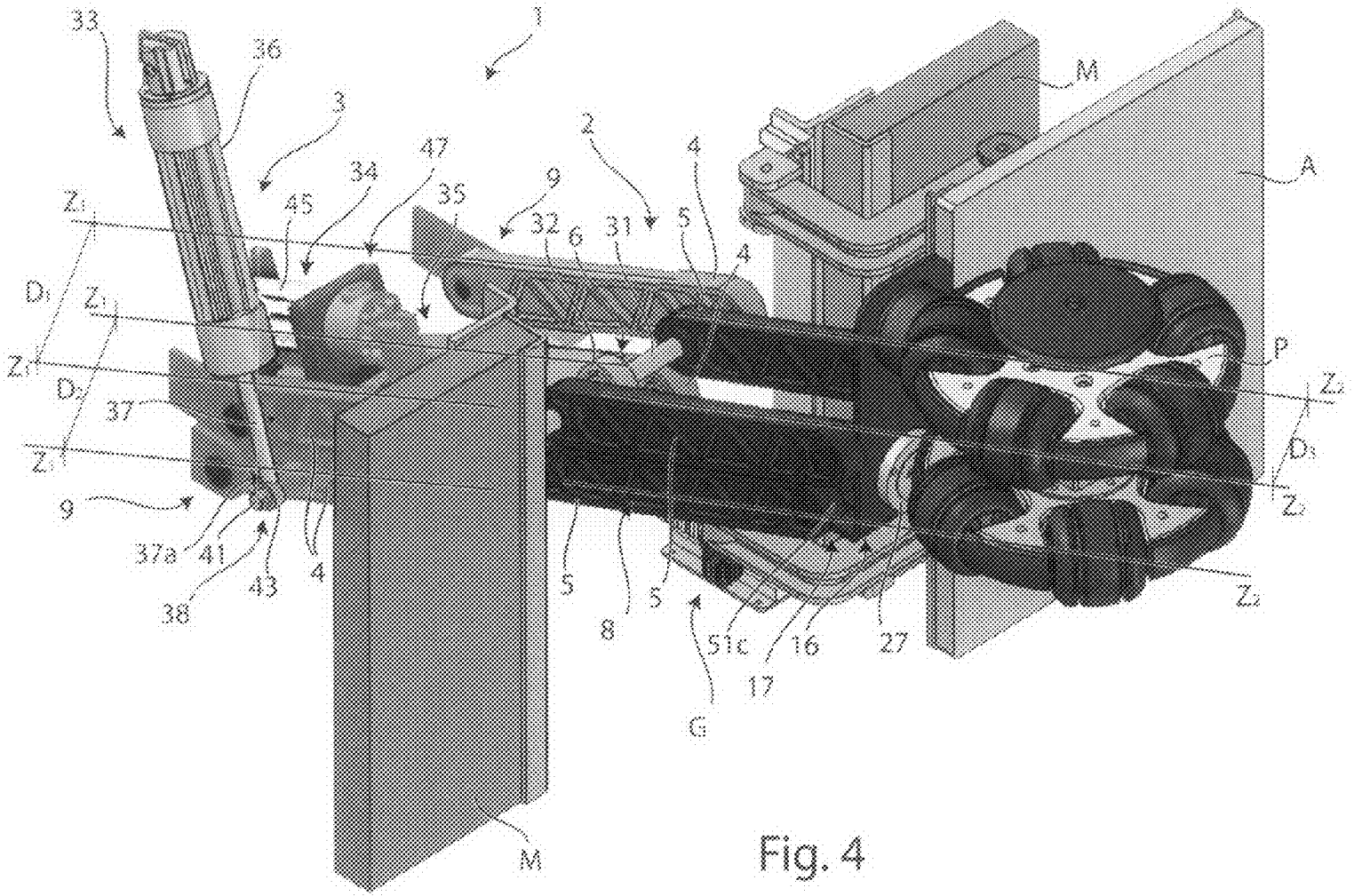
FIG. 4 is a perspective view of the assembly of FIG. 1 in the working position.

According to the invention, the assembly 1 comprises articulation means, as a whole numbered with 2, suitable to be connected to the fender element P, and moving means, as a whole reported with 3, suitable to be coupled with the boat, operatively connected to the articulation means 2 to move them between a working position, shown in FIG. 4, in which they dispose the fender element P protruding laterally from the boat, and a rest position, highlighted in FIG. 1, in which they dispose the fender element P receding with respect to the boat, for example in a special space V realized in proximity to the substantially intermediate area of the side M of the boat.

Figure 6:
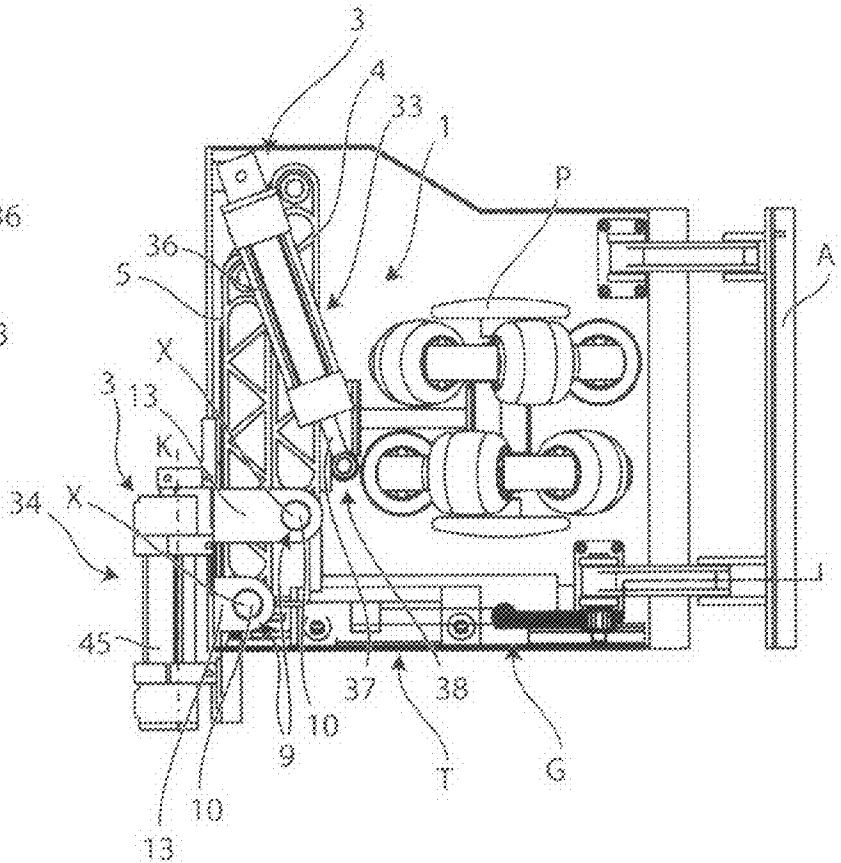
FIG. 6 is a side view of FIG. 1.
Figure 7:
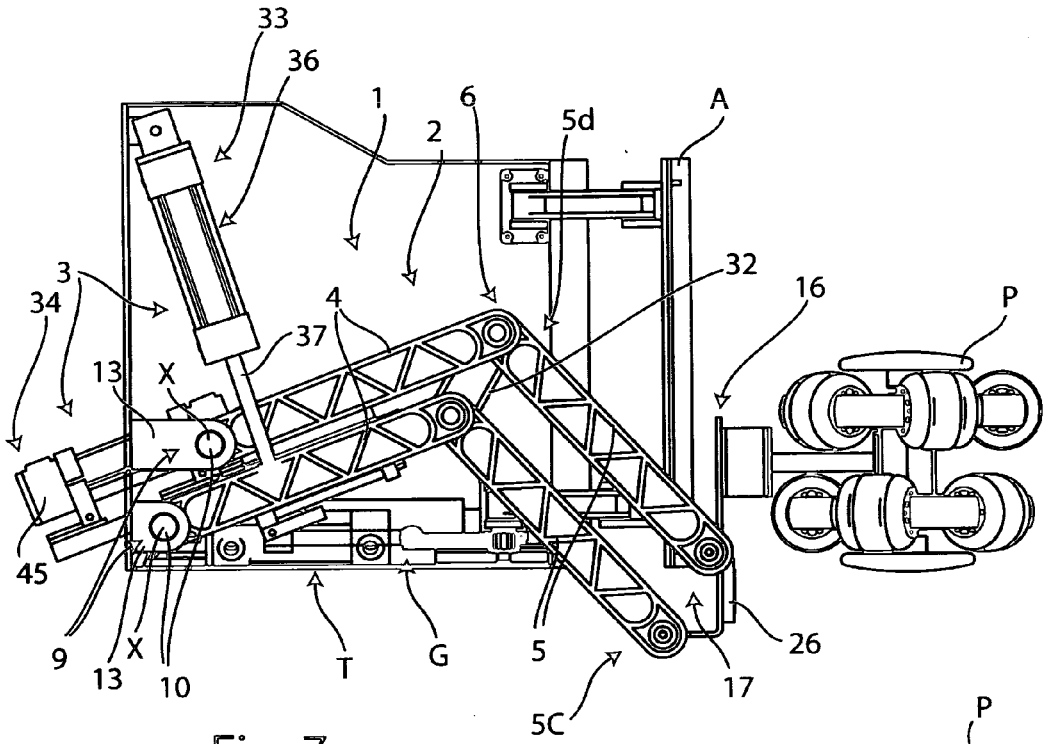
FIG. 7 is a side view of FIG. 3.
Figure 8:
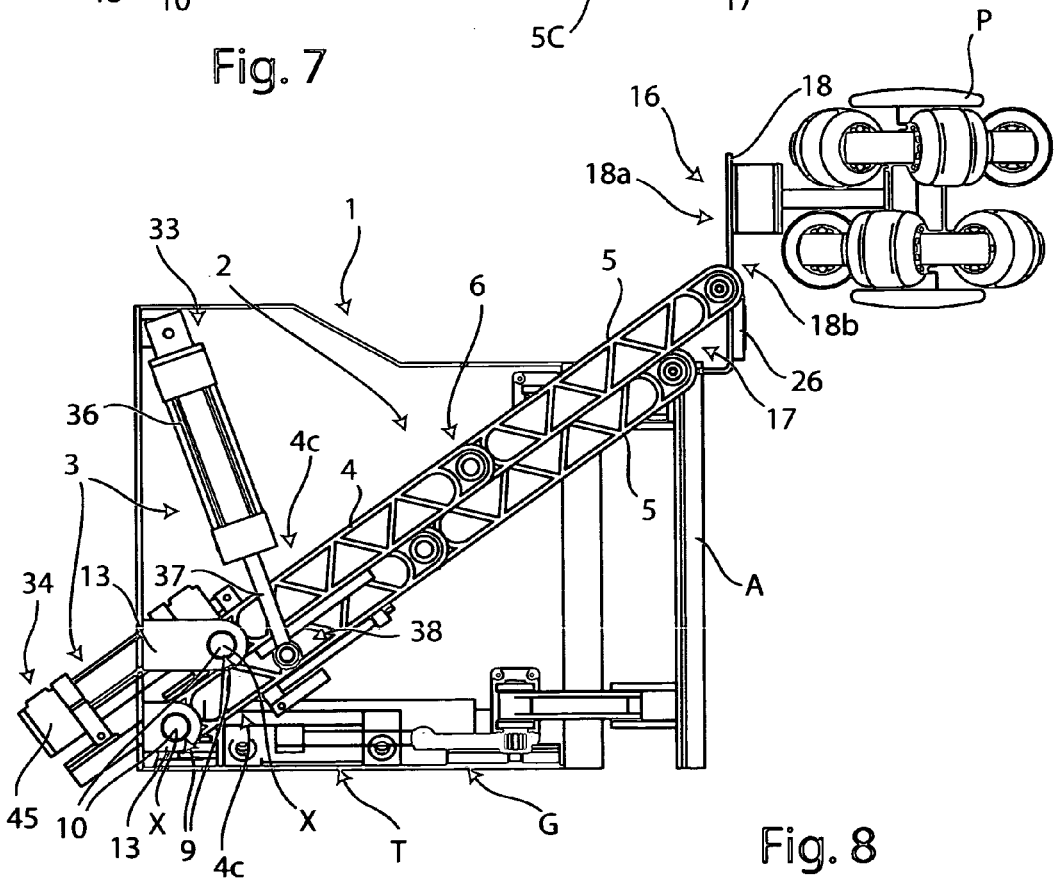
FIG. 8 is a side view of FIG. 4.

In this regard, when the operating assembly 1 is in the rest position of FIG. 1, the space V is appropriately closed by a shutter A connected through the interposition of a transmission assembly G, better visible in FIGS. 6, 7 and 8, to actuator means, overall indicated with T and, for instance, consisting of a linear cylinder of the hydraulic or pneumatic type.

In this operative situation, the fender element P is totally contained in the space V of the boat.

When, out of necessity, the operating assembly 1 must be put in said working position, the shutter A is, instead, moved in such a way to open the space V and allow the exit of the fender element P till to dispose it projecting and side by side the side M of the boat.

Preferably but not necessarily, the operating assembly 1 comprises control means, not shown and for example constitute by a central processing unit, operatively connected to the moving means 3.

The articulation means 2 include a plurality of extension arms reciprocally articulated.

In detail, the articulation means 2 include:

- a plurality of first extension arms 4, one of which connected to the moving means 3 and coupled with the inner wall which delimits the space V of the boat and defining first longitudinal directions $Z_1$ parallel each other;
- a plurality of second extension arms 5, one of which connected to the moving means 3 and cooperating with the fender element P and defining second longitudinal directions $Z_2$ parallel each other.

The first directions $Z_1$ and the second directions $Z_2$ are substantially parallel one each other both in the rest position and in the working position, so that the articulation means 2 realize the typical configuration of a construction known as "pantograph" in mechanical field.

The first extension arms 4 are coupled with the second extension arms 5 by junction means, as a whole numbered with 6.

Each of the extension arms 4, 5 presents on the lateral faces 4*a*, 4*b* and 5*a*, 5*b* a series of lightening hollows 7, 8 which confer to the extension arms 4, 5 a lattice shape, as can be deduced from the lateral views of the respective FIGS. 9 and 10, and, therefore, a certain flexibility.

Figure 5:
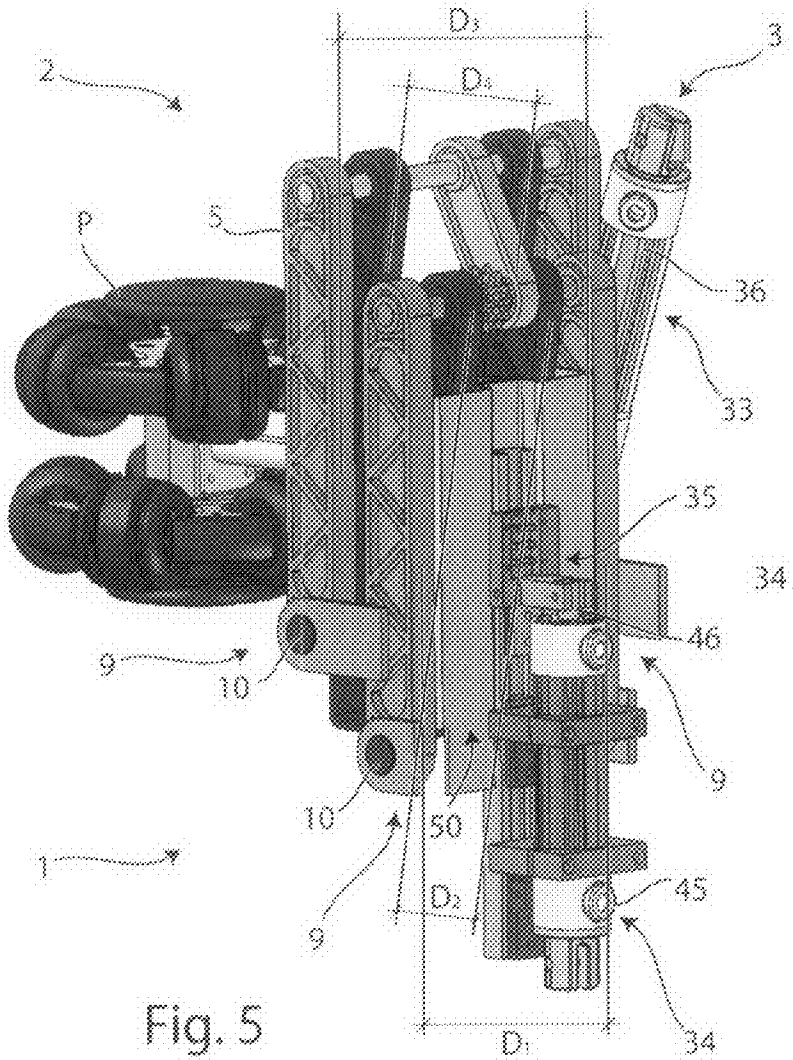
FIG. 5 is the opposed view of FIG. 1.

FIG. 5 shows that, in the described case, the first extension arms 4 include a pair of upper arms one coplanar and facing to the other, for which the first directions $Z_1$ are reciprocally separated of a first distance $D_1$, and a pair of lower arms one coplanar and facing to the other, for which the first directions $Z_1$ are reciprocally separated by a second distance $D_2$ lower than the first distance $D_1$.

Preferably, each of the first extension arms 4 is made of polymeric material, such as polyamide (better known with the commercial name of nylon) and presents a double T-shaped profile in cross section, as shown in FIG. 9*a*.

The operating assembly 1, then, includes fulcrum means, as a whole marked with 9, placed at a first end 4*c* of each of the first extension arms 4, suitable to couple the latter with the boat, more specifically to the inner wall which delimits the space V, as well highlighted by FIGS. 6-8.

The fulcrum means 9 include a mechanical connection member 10 inserted firmly into:

- a first through hole 11, realized in the first end 4*c* of each of the first arms 4;
- a decentralized through hole 12, coaxial to the first through hole 11, realized on a laminar plate 13, shown apart in FIG. 11, which is fixed to the boat.

FIGS. 6-8 explicitly indicate that the through hole 12 of the laminar plate 13 related to each of the lower arms identifies a central axis X staggered with respect to the central axis X of the through hole 11 of the laminar plate 13 of each of the upper arms.

Moreover, the laminar plate 13 of each of the upper and lower arms belonging to the extension arms 4 presents a substantially U-shaped external profile.

The length of the laminar plate 13 of the upper arms is also greater than the length of the laminar plate of the lower arms.

As far as the second extension arms 5 are concerned, they include a pair of superior arms one coplanar and facing to the other, for which the second directions $Z_2$ are reciprocally separated by a third distance $D_3$ lower than the first distance $D_1$, and a pair of inferior arms one coplanar and facing to the other, for which the second directions $Z_2$ are reciprocally separated by a fourth distance $D_4$ lower than the second distance $D_2$ and the third distance $D_3$, as still represented in FIG. 5.

FIG. 10*a* shows that each of the second extension arms 5 presents a double T-shaped profile in cross section and consists of a laminar core 14 made of metallic material, such as harmonic steel, covered by an external layer 15 made of polymeric material, such as polyamide (nylon).

According to the preferred embodiment here examined of the invention, the operating assembly 1 also includes a shaped plaque 16, coupled by union means, as a whole marked with 17, with a first end 5*c* of each of the second extension arms 5, used to support the fender element P, as shown by the introduced FIGS. 1-8.

In FIG. 12 it observes that the shaped plaque 16 presents an L-shaped profile in cross section, being composed of a main portion 18, which in application defines a purely vertical plane, and a folded portion 19, projecting perpendicularly from the main portion 18 with which it is made in a single body.

The folded portion 19 is also provided with a central step 20 coplanar to it.

As an exclusively preferential title, the union means 17 include:

- a main linear bar 21 fixed on a first side surface 18*a* of the main portion 18 and provided with end stretches 21*a*, 21*b* protruding on opposite parts from the main portion 18;
- an auxiliary linear bar 22, placed parallel to the main bar 21 and fixed to the outer edge of the central step 20 from which protrudes for the appendixes 22*a*, 22*b* defining two lateral slots 23, 24 opposed each other which receive the peripheral edge 51*c* of the first end 5*c* of each of the inferior arms of the second extension arms 5;
- first through openings 25, one for each of the first end 5*c* of the second extension arms 5, where the end stretches 21*a*, 21*b* of the main bar 21 and the appendixes 22*a*, 22*b* of the auxiliary bar 22 are housed;
- screw means, not reported, inserted in the first through openings 25 and engaging in female screws 26 disposed in the end stretches 21*a*, 21*b* and in the appendixes 22*a*, 22*b* of the bars 21, 22 respectively.

Advantageously, the shaped plaque 16 is provided with a lighting element 27 used in presence of darkness, placed on a second side surface 18*b* opposite to the first side surface 18*a* of the main portion 18 and, in the working position, facing outwards.

The lighting element 27 is housed in a circular seat 42, better evident in FIGS. 12 and 13, obtained in the main portion 18 of the shaped plaque 16.

In relation to the junction means 6, they include:

- a rotating shaft 28, defining a first longitudinal axis $Y_1$ orthogonal to the first and second longitudinal directions $Z_1$, $Z_2$, inserted into second through openings 29, obtained one for every second end 5*d* of the inferior arms of the second extension arms 5, and into a second through hole 30 obtained in a second end 4*d* of each of the lower arms of the first extension arms 4, as noticeable by FIGS. 9 and 10;
- a cross bar 31, shorter than the rotating shaft 28 and defining a second longitudinal axis $Y_2$ parallel to the first axis $Y_1$, inserted into the second through openings 29, obtained one for every second end 5*d* of the superior arms of the second extension arms 5, and into a second through hole 30 obtained in a second end 4*d* of each of the upper arms of the first extension arms 4.

The junction means 6 also include a strengthening body 32 which connects the substantially intermediate areas 28*a*, 31*a* of the rotating shaft 28 and of the cross bar 31.

The strengthening body 32 presents at the ends 32*a*, 32*b* two peripheral through holes 33, 34, the first of which is passed through by the rotating shaft 28 and the second one is passed through by the cross bar 31. In this case, the operating assembly 1 includes a plurality of spacers, not shown for the sake of simplicity, externally and coaxially coupled with the rotating shaft 28 and to the cross bar 31 in order to interpose among the lower arms, the inferior arms and the strengthening body 32 on one hand, among the upper arms, the superior arms and the strengthening body 32 on the other hand.

As regards the moving means 3, the already mentioned figures show that they include a first linear actuator 33, suitable to be coupled with the boat and operatively connected to one of the upper arms of the first extension arms 4.

In this case, the moving means 3 include, moreover, a second linear actuator 34, operatively connected by transmission means, as a whole marked with 35, to one of the inferior arms of the second extension arms 5.

The first linear actuator 33 comprises a starting cylinder 36, provided with a first stem 37 connected to one of the upper arms of the first extension arms 4 by locking means, overall marked with 38.

In the rest position, the first stem 37 is entirely within the starting cylinder 36, while in the working position it is totally outside the starting cylinder 36, after having completed a stroke variable depending on the project specifications.

As FIGS. 15, 16 also help, in the example described the locking means 38 include:

- a shaped plate 39 fixed to the bottom edge 4*e* of the upper arm and provided with a support base 40 from which protrudes a peg 41 along a linear direction $Y_3$ transverse to the first longitudinal directions $Z_1$;

a ring 43, positioned at the free end 37*a* of the first stem 37, in which the peg 41 fits passing and kept in position by a mechanical fastening member, not shown, inserted into an end through hole 44.

In the following FIGS. 17-19 it is shown that the second linear actuator 34 comprises in turn a completion cylinder 45, provided with a second stem 46 connected by connection means, on the whole indicated with 47, to both upper arms of the first extension arms 4.

In the working position, the second stem 46 is totally within the completion cylinder 45 after an appropriate stroke depending on the project choices, while in the rest position it is totally outside the completion cylinder 45.

As it notices in FIGS. 5, 6, in the rest position the completion cylinder 45 defines a substantially vertical axis K.

In accordance with the preferred embodiment here described, the connecting means 47 include:

a movable clamp 48 and a fixed clamp 49, spaced from each other and tight around the completion cylinder 45;

a laminar body 50, enlarged in FIGS. 20 and 21, interposed between the upper arms of the first extension arms 4;

a shaped fork 51, on one side connected to the free end 46*a* of the second stem 46 of the completion cylinder 45 through bond means, as a whole reported with 52, on the other hand connected to the laminar body 50 through first guide means, as a whole indicated with 53.

The movable clamp 48 is made of metallic material, such as stainless steel; the fixed clamp 49 is, instead, made of plastic material, for example polyoxymethylene (POM) or polytetrafluoroethylene (PTFE, also known under the trademark Teflon®).

More specifically, the movable clamp 48 is connected to the laminar body 50 through seconds guide means, as a whole indicated with 54, while the fixed clamp 49 is fixed to the laminar body 50 by first fastening means, as a whole marked with 55.

FIGS. 22, 23 illustrate that the movable clamp 48 is composed of two parallelepiped bodies 56, 57 one maintained facing and separated to the other at the inside edge 56*a*, 57*a* through first link means, as a whole indicated with 58 and constituted, for example, by screws and relative female screws.

In this way, an open profile circular through hole 59, where the completion cylinder 45 is housed, creates in the movable clamp 48.

In this case, the first link means 58 are symmetrically placed with respect to the circular hole 59, between this and the lateral edge 56*b*, 57*b*.

The fixed clamp 49 is, instead, represented in FIGS. 24 and 25: it is observed that it is composed by two parallelepiped blocks 60, 61 one maintained close to the other in correspondence of the inner edge, not shown, through second link means, as a whole indicated with 62 and, for example, still constituted by screws and female screws.

In doing so, a close profile circular through hole 63, where the cylinder completion 45 is housed, creates in the fixed clamp 49.

Also the second link means 62 are symmetrically arranged with respect to the circular hole 63, between this and the lateral edge 60*b*, 61*b*.

The parallelepiped body 56 of the movable clamp 48 and the parallelepiped block 60 of the fixed clamp 49 present in the outer edge 56*c*, 60*c* a respective central indentation 64, 65 interposed between two peripheric protuberances opposed and facing each other, numbered with 66, 67 and 68, 69 respectively.

The laminar body 50 of FIGS. 20 and 21 includes a medial sector 70, which supports the fixed clamp 49 and is provided with a folded section 71 which defines in the rear surface 70*a* a central cavity 72 having a linear axis H.

The laminar body 50 also includes a pair of side wings 73, 74, opposed one another, forming a right angle with the medial sector 70, each of which is fixed to the lateral faces 4*b* one facing to the other of the upper arms of the first extension arms 4.

As shown in FIGS. 26 and 27, the shaped fork 51 preferably presents an L-shaped profile in cross section.

It notes that the shaped fork 51 includes a supporting block 75 presenting at one end a central notch 76 which receives one end 46*a* of the second stem 46 and is interposed between two side walls 77, 78 opposed and facing one another.

The shaped fork 51 also comprises a hooking block 79 having a thickness "s" lower than the thickness "S" of the supporting block 75.

Preferably but not exclusively, the first guide means 53 comprise:

a rear longitudinal track 80, coupled in the central cavity 72 of the medial sector 70 from which protrudes for a lower stretch 80*a* measured along the linear axis H;

a first shaped sliding block 81, to which the shaped fork 51 is integral, which slides on the rear longitudinal track 80.

Figure 28:
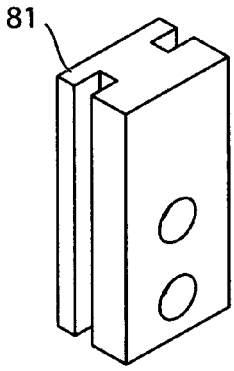

In cross section, the rear longitudinal track 80 presents a substantially C-shaped profile and the first shaped sliding block 81, shown in FIG. 28, presents a substantially Ω-shaped profile.

The bond means 52, always referred to the shaped fork 51, include a first pin 82 inserted into two through holes 83, 84 reciprocally coaxial, each of which made in one of the side walls 77, 78 of the supporting block 75 of the shaped fork 51.

The first pin 82 is also inserted into a hole, not visible and coaxial to the aforesaid through holes 84, 85, made at the end 46*a* of the second stem 46 along an axis orthogonal to the axis defined by the same second stem 46.

Moving on to describe in detail the first fastening means 55, they include an intermediate rise 86, connected to the parallelepiped block 60 of the fixed clamp 49 by a second pin, not visible, inserted into through openings 87, 88 reciprocally coaxial, obtained in the peripheric protuberances 68, 69 of the parallelepiped block 60.

The second pin is also inserted into a through opening, not visible and coaxial to the through openings 87, 88, obtained in a projecting portion of the intermediate rise 86 contained in the central indentation 65 of the parallelepiped block 60.

The first fastening means 55 include, then, a first shaped insert 89 to which the intermediate rise 86 is integral, steadily conjugate in the rear longitudinal track 80.

Figure 29:
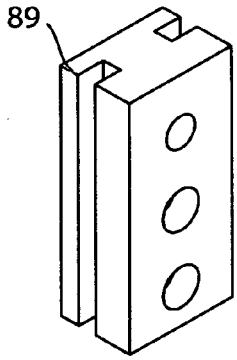

In cross section, the intermediate rise 86 presents an L-shaped profile and the first shaped insert 89, enlarged in FIG. 29, a substantially Q-shaped profile, like the first sliding block 81.

As far as the second guide means 54 are concerned, they comprise a lower rise 90, connected to the parallelepiped body 56 of the movable clamp 48 by a third pin, not visible, inserted into through openings 91, 92 reciprocally coaxial, obtained in the peripheric protuberances 66, 67 of the parallelepiped body 56.

The third pin is also inserted into a through opening 93 coaxial to the through openings 91, 92, obtained in a projecting area 94 of the lower rise 90 contained in the central indentation 64 of the parallelepiped body 56.

The second guide means 54 include, then, a second shaped sliding block 95 to which the lower rise 90 is integral, which slides on the rear longitudinal track 80 in correspondence of the lower stretch 80*a*.

Figure 30:
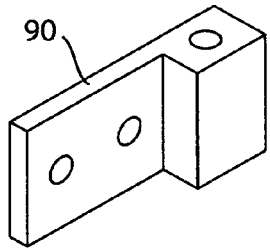

The lower rise 90, shown in FIG. 30, presents in cross section an L-shaped profile while the second shaped sliding block 95 presents in cross section a substantially Ω-shaped profile, like the first shaped sliding block 81 and the first insert 89.

From a constructive point of view, the first sliding block 81, the second sliding block 95 and the first insert 89 equally protrude from the rear surface 70*a* of the medial sector 70.

In an advantageous way, the operating assembly 1 includes elastic means, not shown, arranged around the completion cylinder 45 between the movable clamp 48, which supports them, and the fixed clamp 49.

Such elastic means, for instance represented by a spring, load for traction when, during use, the fender element P suffers an impact, making elastically yielding the movable clamp 48 along the linear axis H.

This allows to mitigate the negative effects arising from the accidental collisions and, conversely, to make the operating assembly 1 damped.

With reference to the transmission means 35, they include a cut off chain 96 shown in schematic form in FIGS. 17-19, which presents a first end 96*a* connected to a first support element 97 integral with the shaped fork 51 and a second end 96*b* connected to a second support element 98.

The second support element 98 is coupled with the laminar body 50, at the opposite side of the shaped fork 51, through third guide means, as a whole numbered with 99.

Figure 31:
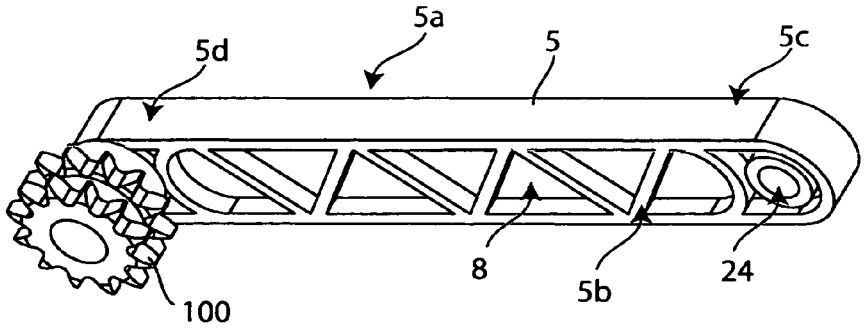

The transmission means 35 also comprise a pinion 100 on which engages the cut off chain 96, coaxial to the rotating shaft 28 and laterally protruding from one of the inferior arms of the second extension arms 5, as FIG. 31 shows.

The pinion 100 is firmly connected to the second end 5*d* of one of the inferior arms of the second extension arms 5.

Figure 32:
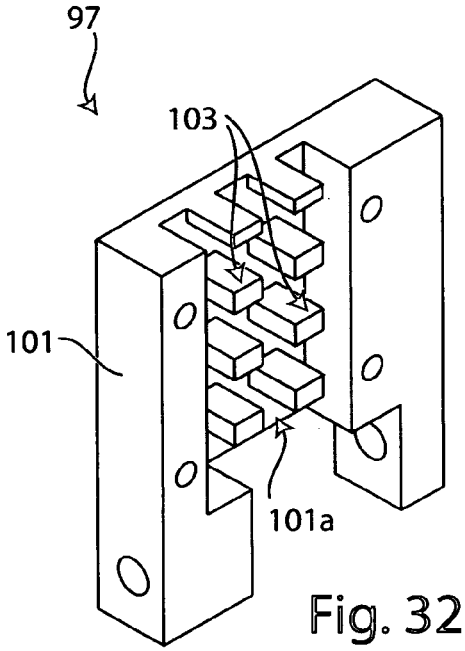
Figure 33:
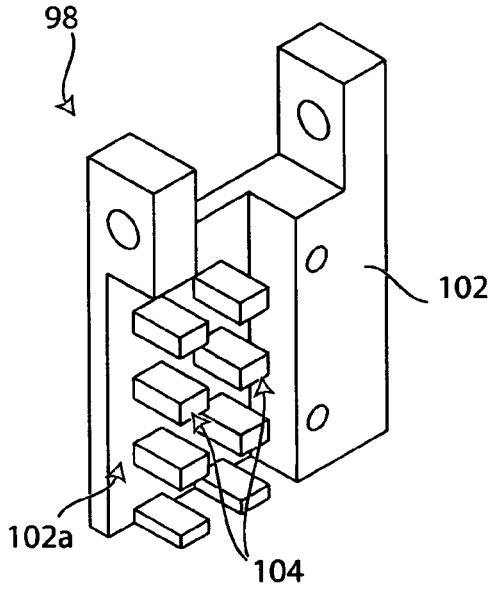

The support elements 97, 98 are partly represented in the respective FIGS. 32 and 33.

Each of these support elements 97, 98 is composed of a first bracket 101, 102 provided with a plurality of teeth 103, 104, which extend from the side wall 101*a*, 102*a*, to which respectively the end 96*a*, 96*b* of the cut off chain 96 hooks.

Each of the support elements 97, 98 also consists of a second bracket, not shown, fitting with the first bracket 101, 102 with which is permanently coupled by seal means, not reported and constituted for example by screws, to cover the teeth 103, 104 and the end 96*a*, 96*b* of the cut off chain 96.

In turn, the third guide means 99 include a front longitudinal track 105, coupled with the anterior surface 70*b*, opposed to the rear surface 70*a*, of the medial sector 70 and a third shaped sliding block 106, which slides on the front longitudinal track 105 and is connected to the second support element 98 by interposing a rise baffle 107.

The front longitudinal track 105 presents in cross section a C-shaped profile, like the rear longitudinal track 80.

Preferably, the third guide means 99 also include a sliding rod 108 which defines a straight direction J parallel to the linear axis H and along which the third shaped sliding block 106 and the second support element 98 are movable.

Figure 34:
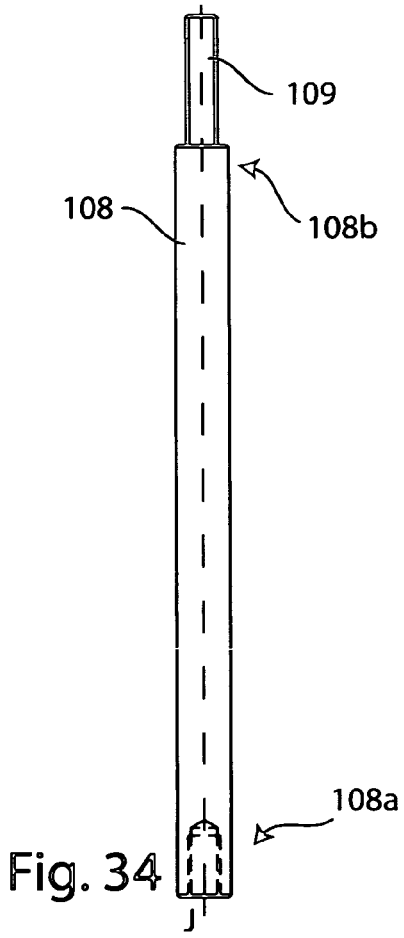

The sliding rod 108, shown in detail in FIG. 34, is fixed at one end 108*a* to the rise baffle 107 and at the opposite end 108*b* is provided with an indented coaxial peg 109, having section smaller than the one of the rod 108, which is inserted into a stop small block 110, frontally integral with a second shaped insert 111 steadily conjugate in the front longitudinal track 105.

Figure 35:
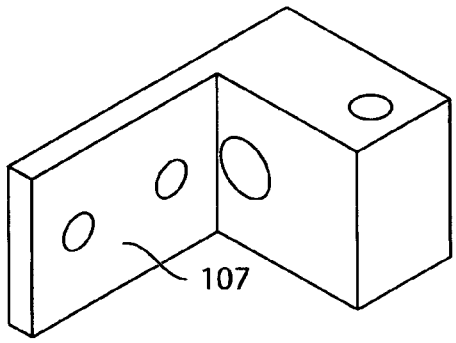
Figure 36:
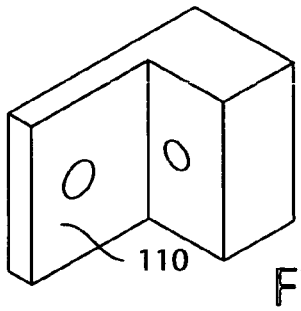

The rise baffle 107 and the stop small block plug 110, respectively shown in FIG. 35 and FIG. 36, present an L-shaped profile in cross section.

The third sliding block 106 and the second insert 111 protrude of the same extent from the anterior surface 70*b* of the medial sector 70 and present a substantially Ω-shaped profile in cross section.

It should be also underlined that, in a preferred but not binding way, the sliding blocks 81, 95, 106 and the shaped inserts 89, 111, are made of synthetic material, such as nylon or polyoxymethylene (POM).

It is also specified that the starting cylinder 36 of the first linear actuator 33 and the completion cylinder 45 of the second linear actuator 34 will be chosen without distinction among the common constructive forms nowadays available, namely hydraulic, oil or water, or pneumatic cylinders.

In use, from the rest position of FIG. 1, after the opening of the space V by moving the shutter A, the control means drive the first linear actuator 33, achieving the leakage of the first stem 37 of the starting cylinder 36 and realizing the clockwise rotation of the first extension arms 4.

Figure 2:
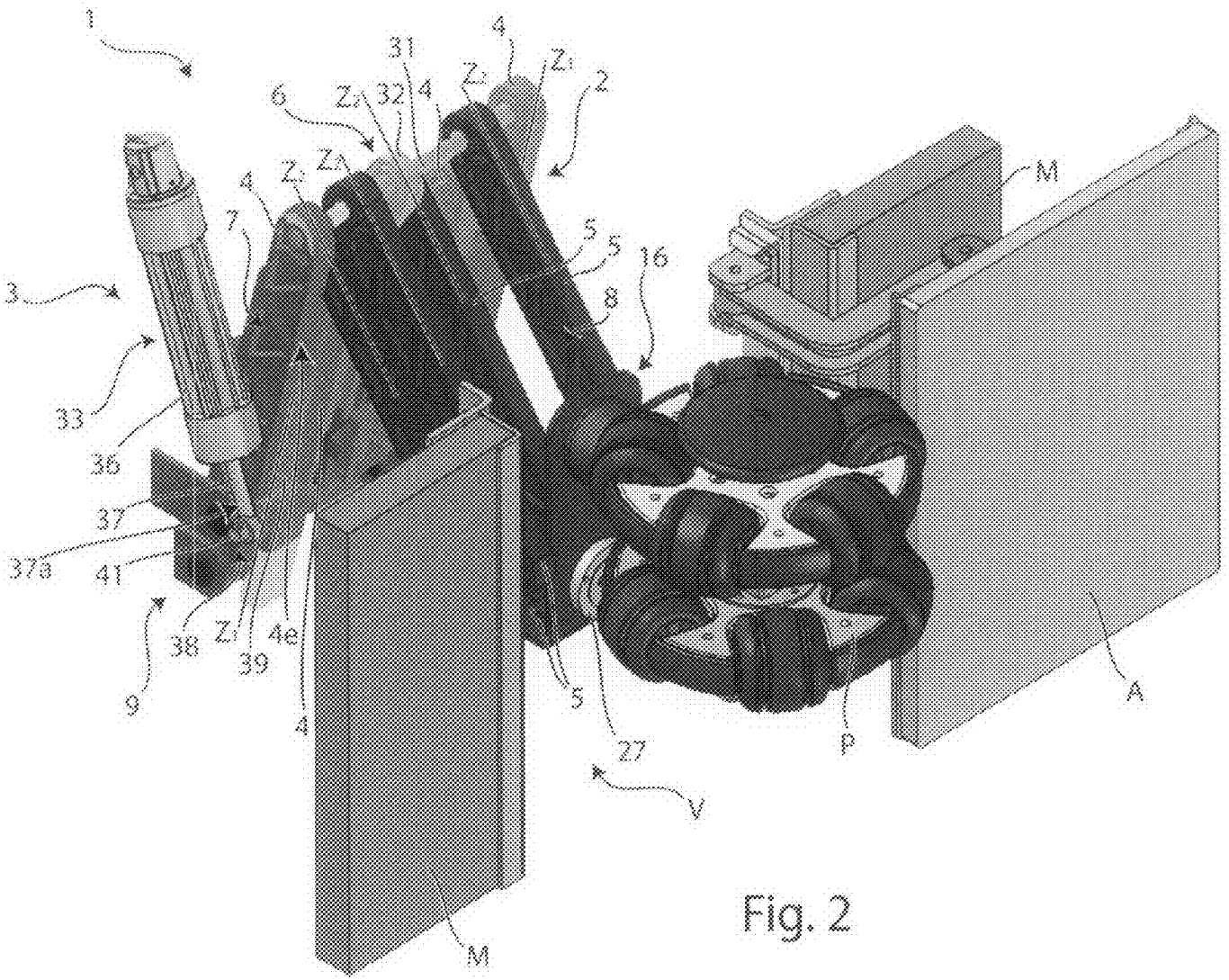
FIG. 2 is a perspective view of the assembly of FIG. 1 in a first operative condition.

FIG. 2 represents the operating assembly 1 in a position where the first stem 37 has not yet reached the stop and the rotation of the first extension arms 4 is not yet finished.

The control means drive the second linear actuator 34 when the first stem 37 has already completed its stroke or, alternatively, a few moments earlier, depending on the planning parameters of the components of the operating assembly 1, the space V and the fender element P.

The second stem 46 thus re-enter in the completion cylinder 45 moving the cut off chain 96 which, in turn, rotates the pinion 100 and with this the rotating shaft 28.

Figure 3:
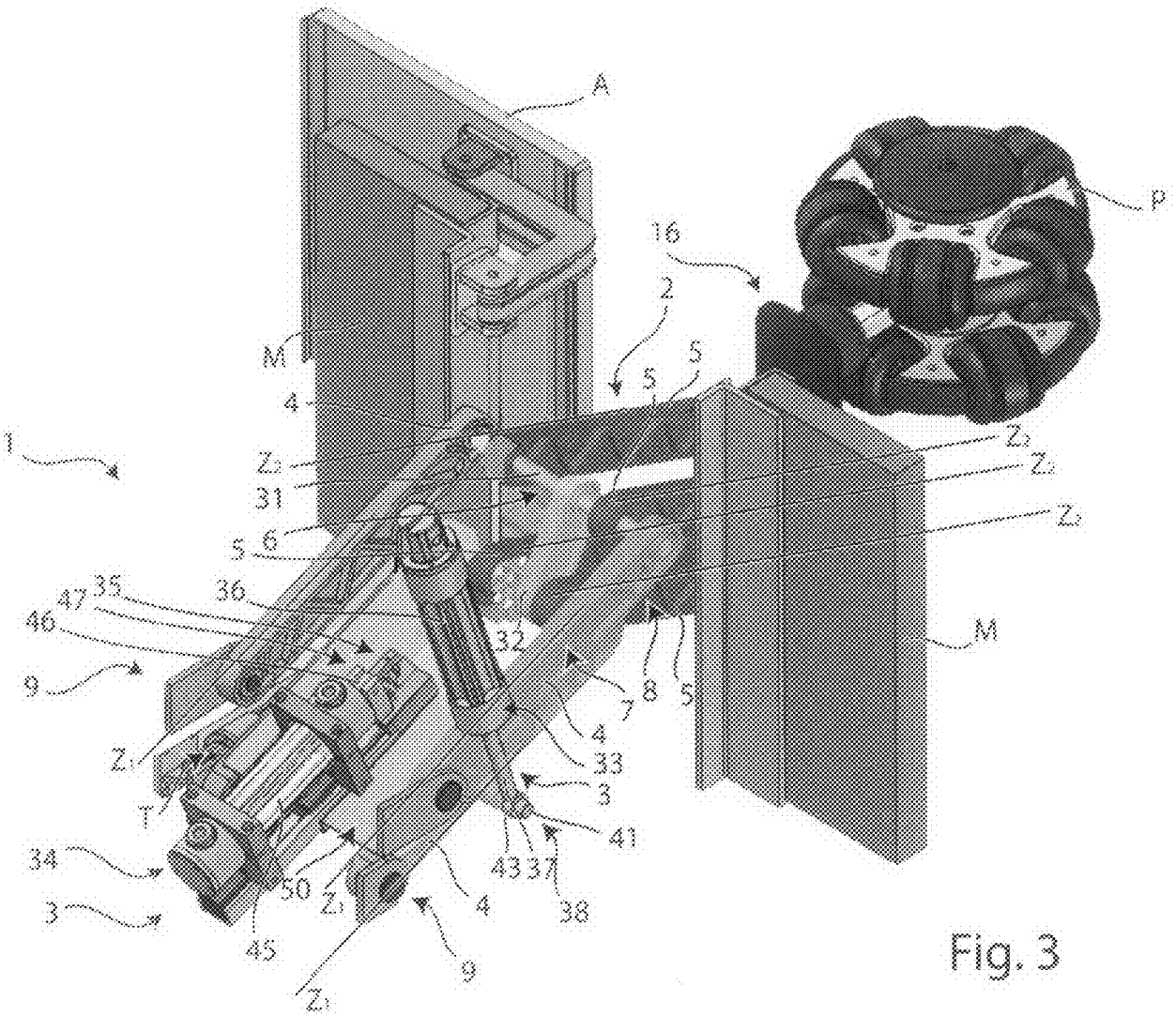
FIG. 3 is a perspective view of the assembly of FIG. 1 in a second operative position.

In this manner, the fender element P is actually pushed outside of the boat, according to what it is reproduced in the FIGS. 3 and 4 one consecutive to the other which show the operating assembly 1 respectively while the second extension arms 5 are still moving and in the final working position.

The pantograph system of the operating assembly 1, produced by the first and second extension arms 4, 5, keeps the shaped plaque 16 which supports the fender element P always in a substantially vertical plane.

FIGS. 37 and 38 show another embodiment of the invention, variant of the embodiment just described, in which the operating assembly, now globally numbered with 200, differs from the operating assembly 1 both for the articulation means, as a whole marked with 201, and for the moving means, as a whole signalled with 202.

Indeed, the articulation means 201 include only a pair of extension arms 203, 204 parallel to each other and of equal length L.

In correspondence of a first end 203*a*, 204*a*, the extension arms 203, 204 are connected one each another through a spacer 205.

The second end 203*b*, 204*b* of the extension arms 203, 204 is connected through fulcrum means, totally marked with 206, to a box body 207 inserted into the space made in the wall of the boat and which, in the rest position, continues to completely receive the fender element P, as can be deduced from FIG. 37.

Furthermore, the fender element P is connected to the spacer 205 by coupling means, as a whole numbered with 208.

The moving means 202 comprise in turn only the starting cylinder 209, of the hydraulic, oil or water, or of the pneumatic type.

On one side the starting cylinder 209 is connected through locking means, overall indicated with 210, to the extension arms 203, 204 near the intermediate zone 203*c*, 204*c* thereof, on the other side it is connected to the box body 207 through guide means, as a whole marked with 211.

In this case, the locking means 210 include a supporting shaft 212, positioned parallel to the spacer 205 and whose ends are firmly fixed to the extension arms 203, 204, and a ring 214 which protrudes from the stem 213 of the starting cylinder 209 and is externally and coaxially coupled with the supporting shaft 212.

Specifically, the guide means 211 include a longitudinal track 215, fixed to the box body 207, a threaded bar 216 defining a vertical direction Y' and provided with an end 216*a* coupled with a shaped insert 217 connected to the lower terminal part 215*a* of the longitudinal track 215.

The guide means 211, then, include a sliding block 218 which, in the rest position of the fender element P, is disposed close to the upper terminal part 215*b* of the longitudinal track 215, to a predetermined distance D from the shaped insert 217.

The sliding block 218 is movable on this longitudinal track 215 and along the threaded bar 216 which is passing through the sliding block 218.

Elastic means, as a whole indicated with 219 and surrounding the threaded bar 216, are placed between the sliding block 218 and the shaped insert 217: their function is to mitigate the effects of the impacts suffered by the fender element P and transmitted to the extension arms 203, 204.

The sliding block 218 moves along the vertical direction Y' to bring the fender element P in the working position, dragging with it the starting cylinder 209 and realizing the complete exit of the stem 213.

In this way, the extension arms 203, 204 perform a clockwise rotation that causes a similar rotation of the fender element P which therefore exits from the box body 207 inside the space to place itself outside the boat and act as a protection of the boat to which it is assigned.

FIGS. 39 and 40 illustrate a further embodiment of the invention in which the operating assembly, globally indicated with 300, differs from the previous ones yet described for the different composition of the articulation means, as a whole marked with 301, connected to the moving means, overall numbered with 302.

The articulation means 301, indeed, comprise a first extension arm 303 and a second extension arm 304 one telescopic to the other, connected to a single linear actuator 305 which is associated to the boat in correspondence of a first portion 306*a* of the box body 306 more internal with respect to a second portion 306*b* which, in the rest position, contains the fender element P.

The second extension arm 304, more internal, is connected by coupling means, as a whole indicated with 307, to the fender element P and, in the working position, partly protrudes from the box body 306 inserted in the space of the boat.

In the working position, the first extension arm 303 remains, however, inside the box body 306, even though moving from the internal portion 306*a* to the external portion 306*b*.

In FIGS. 41 and 42 it is reported another embodiment of the invention where the operating assembly, generally indicated with 400, differs from the previous ones again for the articulation means, as a whole numbered with 401.

In the case in exam, the articulation means 401 include two first extension arms 403 connected each other by articulated joint means and two second extension arms 404, also connected each other by articulated joint means, in order to make up a typical pantograph structure.

One end 403' of a first extension arm 403 is connected through first guide means, as a whole marked with 405, to a box body 406 placed in a space of the boat.

One end 404' of a second extension arm 404, opposed to the end 403', is connected to the box body 406 through first fulcrum means, overall marked with 407. One end 403" of the other first extension arm 403 is, instead, connected through second guide means, totally indicated with 408, to a base plate 409 connected to the fender element P through coupling means, as a whole numbered with 410.

One end 404" of the other second extension arm 404 is connected to the base plate 409 through second fulcrum means, overall marked with 411.

The moving means, overall indicated with 402, are connected to the boat through attach means, as a whole indicated with 412, and also to one of the extension arms 403 through support means, overall marked with 413.

Note in this constructive example the different form of the fender element P connected to the operating assembly 400 of the invention.

As an alternative to the already mentioned embodiments, FIG. 43 suggests another execution of the invention, with the operating assembly globally numbered with 500.

The particularity of the operating assembly 500 with respect to the ones already highlighted still lies in the composition of the articulation means 501 which comprise two first extension arms 503, 504 one parallel and articulated to the other, clearly visible in FIG. 44, and a second extension arm 505 connected to the fender element P.

Only the first extension arm 503 is connected to a first linear actuator 507 belonging to the moving means 502 through locking means, as a whole marked with 506 and of the type already described above.

The moving means 502 also include a second linear actuator, not visible, connected to both the first extension arms 503, 504 through transmission means, as a whole indicated with 508.

In detail, the transmission means 508 include a support shaft 509, which connects one another the first extension arms 503, 504, and a pair of pinions, only one of which is visible, indicated with 510.

A closed chain 511, cinematically connected to guide means, not visible, coupled with the second linear actuator, engages on the pinions.

In FIG. 43 the fender element P, different from those shown in the figures already described, is inside the space V made in the boat, then in the rest position.

FIG. 45 shows, instead, the operating assembly 500 in a first possible working position, that one for which the extension arms 503, 504 place the fender element P protruding from the boat at the point of maximum extension downwards, due to the operation of the first linear actuator 507 by the control means.

FIG. 46, instead, reports the operating assembly 500 in a second working position, which takes place after the one of FIG. 45, according to which the fender element P, remaining always protruding from the boat, is brought at the point of maximum extension upward.

This is due to the operation of the second linear actuator which puts in anticlockwise rotation the second extension arm 505 through the transmission means 508.

Finally, FIG. 47 refers to a new embodiment of the invention, according to which the operating assembly, globally indicated with 600, differs from those already discussed for the form of the articulation means as well as for the location and composition of the moving means.

Moreover, the operating assembly 600 is also suitable to be installed on the boat in a location different from the one of the operating assemblies 1, 200, 300, 400 and 500 for which, as mentioned above, the ideal location is given by the substantially intermediate zone of the sides of the boat itself.

Indeed, the operating assembly 600 is preferably but not exclusively designed to be applied for and used in the stern area of the sides of the boat.

The articulation means, as a whole marked with 601, include a vertical pivot 603 which is coupled with the boat through a support plate 608.

The vertical pivot 603 defines a rotation axis Y" and cooperates with the moving means, as a whole numbered with 602.

Furthermore, the articulation means 601 comprise a plurality of extension arms reciprocally articulated, as for the operating assemblies 400 and 500.

In particular, the extension arms include a plurality of first extension arms 604, coupled with the vertical pivot 603 through fulcrum means, overall marked with 605, defining the first longitudinal directions one parallel to the other, not indicate for convenience.

The extension arms also comprise a plurality of second extension arms 606, which cooperate with the fender element P and identify the second longitudinal directions one parallel to the other, not shown.

One of the first extension arms 604 and one of the second extension arms 606 are connected to the moving means 602.

Even in this constructive example, the first extension arms 604 are coupled with the second extension arms 606 through junction means, as a whole numbered with 607.

The moving means 602 here include a main linear actuator 609, which defines a horizontal scroll axis X" and is placed on the aforesaid support plate 608. The main linear actuator 609, such as a hydraulic or pneumatic cylinder, is connected on one side to the vertical pivot 203 by means of a shaped bracket 610 and on the opposite side to the support plate 608 by means of an auxiliary pin 612.

The moving means 602 also include a first linear actuator 611 and a second linear actuator, not visible in the FIGS. 47-49, of the type already described for the operating assembly 1.

More specifically, the first linear actuator 611 is operatively connected to one of the lower arms and to one of the upper arms of the first extension arms 604.

The second linear actuator, instead, is operatively connected to one of the inferior arms and to one of the superior arms of the second extension arms 606 through transmission means, not indicated.

In use conditions, the operating assembly 600 provides that, starting from the initial rest position of FIG. 47, the drive of the main linear actuator 609 causes a rotation of the entire structure around the vertical axis Y", clockwise or anticlockwise, not exceeding 90°.

From the reached position, which already represents a working position, the first linear actuator 611 is preferably operated to raise the fender element P to a different and more appropriate working position, illustrated in FIG. 48.

Optionally, the operating assembly 600 passes from the working position just mentioned to another working position, always shown in FIG. 58, where the fender element P is further raised to assume a higher position.

This is achieved by operating the second linear actuator and with it the transmission means connected to the second extension arms 606.

On the basis of what has just explained, it is understandable, therefore, that the assembly for operating fender elements suitable to protect a boat during the movement and/or mooring reaches the purposes and realizes the advantages already mentioned.

In execution, changes can be made to the assembly of the invention which, for example, are realized by a composition of the articulation means different from those described in the embodiments mentioned during the result.

In addition, other solutions of the invention may exist in which the moving means are of different composition in comparison to those previously mentioned.

Moreover, the moving means can be operated in a different way from the one previously mentioned, which does not affect the advantage provided by the present patent.

The operating assemblies and, consequently, the fender elements supported by them, will be installed on the boat in any number, depending on the size of the boat itself.

It is clear, then, that many other variations can be made to the operating assembly in question, without for this reason going out of the novelty principles inherent of the idea inventive, as it is clear that, in the practical implementation of the invention, materials, shapes and sizes of the details could be any, depending on the needs, and could be replaced with other technically equivalent.

The invention claimed is:

1. Assembly (1; 200; 300; 400; 500; 600) for operating fender elements (P) suitable to protect a boat during the movement and/or mooring characterized in that it comprises:

articulation means (2; 201; 301; 401; 501; 601) suitable to be connected to said fender element (P); moving means (3; 202; 302; 402; 502; 602), suitable to be coupled with said boat, operatively connected to said articulation means (2; 201; 301; 401; 501; 601) for moving them between at least a working position in which they dispose said fender element (P) at least partly laterally protruding from said boat and at least a rest position in which they dispose said fender element (P) receding inside the boat thus being hidden in said rest position said articulation means (2; 301; 401; 501; 601) include:

one or more first extension arms (4; 303; 403, 503; 504; 604), suitable to be coupled with said boat and defining first longitudinal directions ($Z_1$)parallel each other, at least one of which connected to said moving means (3; 302; 402; 502; 602);

one or more second extension arms (5; 304; 404; 505; 606), suitable to cooperate with said fender element (P) and defining second longitudinal directions ($z_2$) parallel each other, said first extension arms (4; 303; 403; 503; 504; 604) being coupled with said second extension arms (5; 304, 404; 505; 606) by junction means (6; 607), said first extension arms (4; 604) include a pair of upper arms one coplanar and facing to the other, for which said first directions ($Z_1$)are reciprocally separated by a first distance ($D_1$), and a pair of lower arms one coplanar and facing to the other, for which said first directions ($Z_1$) are reciprocally separated by a second distance ($D_2$) lower than said first distance ($D_1$).

2. Assembly (1; 400; 500; 600) as defined in claim 1) characterized in that said articulation means (2; 401; 501; 601) include a plurality of extension arms (4, 5; 403, 404; 503, 504, 505) reciprocally articulated.

3. Assembly (1; 500; 600) as defined in claim 1) characterized in that at least one of said second extension arms (5; 505; 606) is connected to said moving means (3; 502; 602)

4. Assembly (1; 300; 500) as defined in claim 1 characterized in that said first directions ($Z_1$) and said second directions ($Z_2$) are substantially parallel each other in said rest position.

5. Assembly (1; 600) as defined in claim 1 characterized in that each of said extension arms (4, 5; 604, 606) presents on at least one of the lateral faces (4a, 4b, 5a, 5b) one or more lightening hollows (7, 8) suitable to give to said extension arms (4, 5; 604, 606) a lattice form.

6. Assembly (1; 600) as defined in claim 1) characterized in that each of said first extension arms (4; 604) is made of polymeric material and presents a double T-shaped profile in cross section.

7. Assembly (1; 600) as defined in claim 1) characterized in that it includes fulcrum means (9; 605), placed to a first end (4c) of each of said first extension arms (4; 604), suitable to couple said first arms (4; 604) with said boat.

8. Assembly (1) as defined in claim 7) characterized in that said fulcrum means (9) comprise a mechanical connection member (10) inserted permanently into:

a first through hole (11) obtained in said first end (4c) of each of said first arms (4);

a decentralized through hole (12), coaxial to said first through hole (11), made on a laminar plate (13) suitable to be fixed to said boat.

9. Assembly (1) as defined in claim 8) characterized in that said through hole (12) of said laminar plate (13) related to each of said lower arms defines a central axis (X) staggered with respect to the central axis (X) of said through hole (12) of said laminar plate (13) related to each of said upper arms.

10. Assembly (1) as defined in claim 8) characterized in that said laminar plate (13) of each of said upper and lower arms presents a substantially U-shaped external profile and the length of said laminar plate (13) of said upper arms is greater than the length of said laminar plate (13) of said lower arms.

11. Assembly (1; 600) as defined in claim 1) characterized in that said second extension arms (5; 606) include a pair of superior arms one coplanar and facing to the other, for which said second directions ($Z_2$) are reciprocally separated by a third distance ($D_3$) lower than said first distance ($D_1$), and a pair of inferior arms one coplanar and facing to the other, for which said second directions ($Z_2$) are reciprocally, separated by a fourth distance ($D_4$) lower than said second distance ($D_2$) and not higher than said third distance ($D_3$).

12. Assembly (1) as defined in claim 1 characterised in that each of said second extension arms (5) presents a double T-shaped profile in cross section and consists of a laminar core (14) made of metallic material covered by an external layer (15) made of polymeric material.

13. Assembly (1) as defined in claim 11) characterized in that it includes a shaped plaque (16), coupled through union means (17) with a first end (5c) of each of said second extension arms (5), suitable to support said fender element (P).

14. Assembly (1) as defined in claim 13) characterized in that said shaped plaque (16) presents an L-shaped profile in cross section, being composed of a main portion (18) defining a substantially vertical plane, and a folded portion (19), projecting perpendicularly from said main portion (18) with which it is made in a single body, provided with a central step (20) coplanar to said folded portion (19).

15. Assembly (1) as defined in claim 14) characterized in that said union means (17) include:

a main linear bar (21) fixed on a first aide surface (18a) of said main portion (18) and provided with end stretches (21a, 21b) which remain protruding on opposite parts from said main portion (18);

an auxiliary linear bar (22), placed parallel to said main bar (21) and fixed on the outer edge of said central step (20) from which protrudes for the appendixes (22a, 22b) defining two lateral slots (23, 24) opposed each other which receive the peripheral edge (51c) of said first end (5c) of each of said inferior arms;

first through openings (25), one for each of said first end (5c) of said second extension arms (5), where said end stretches (21a, 21b) of said main bar (21) and said appendixes (22a, 22b) of said auxiliary bar (22) are housed;

screw means inserted into said first through openings (25) and engaging in female screws (26) disposed in said end stretches (21a21b) and in said appendixes (22a, 22b) of said bars (21, 22), 16. Assembly (1) as defined in claim 15) characterized in that said shaped plaque (16) is provided with a lighting element (27) suitable to be used in presence of darkness, placed on a second side surface (18b) opposite to said first side surface (18a) of said main portion (18) and facing outwards in said working position.

17. Assembly (1) as defined in claim 11) characterized in that said junction means (6) include:

a rotating shaft (28), defining a first longitudinal axis ($Y_1$) orthogonal to said first and second longitudinal directions ($Z_1$, $Z_2$), inserted into second through openings (29), obtained one for every second end (5d) of said inferior arms of said second extension arms (5), and into a second through hole (30), obtained in a second end (4d) of each of said lower arms of said first extension arms (4);

a cross bar (31), defining a second longitudinal axis ($Y_2$) parallel to said first axis ($Y_1$), inserted into second openings (29), obtained one for every second end (5d) of said superior arms of said second extension arms (5), and into a second through hole (30) obtained in a second. end (4d) of each of said upper arms of said first extension arms (4).

18. Assembly (1) as defined in claim 17) characterized in that said junction means (6) comprise a strengthening body (32) connecting the intermediate areas (28a, 31a) of said rotating shaft (28) and of said cross bar (31) and which presents at the ends (32a, 32b) two peripheral through holes (33, 34), the first of which is passed through by said rotating shaft (28) and the second one is passed through by said cross bar (31).

19. Assembly (1) as defined in claim 18) characterized in that it includes a plurality of spacers, externally and coaxially coupled with said rotating shaft (28) and said cross bar (31) in order to interpose among said lower arms, said inferior arms and said strengthening body (32) on one hand and among said upper arms, said superior arms and said strengthening body (32) on the other hand.

20. Assembly (1; 600) as defined in claim 11) characterized in that said moving means (3; 602) comprise a first linear actuator (33; 611), suitable to be coupled with said boat and operatively connected to at least one of said upper arms of said first extension arms (4; 604).

21. Assembly (1; 600) as defined in claim 20) characterized in that said moving means (3; 602) include a second linear actuator (34), operatively connected by transmission means (35) to at least one of said inferior arms of said second extension arms (5; 606).

22. Assembly (1) as defined in, claim 21) characterized in that said first linear actuator (33) includes a starting cylinder (36), provided with a first stem (37) connected by locking means (38) to one of said upper arms of said first extension arms (4), said first stem (37) being totally within said starting cylinder (36) in said rest position and totally outside said starting cylinder (36) in said working position.

23. Assembly (1) as defined in claim 22) characterized in that said locking means (38) comprise:

a shaped plate (39) fixed to the bottom edge (4*e*) of said upper arm and provided with a support base (40) from which protrudes a peg (41) along to a linear direction ($Y_3$) transverse to said first longitudinal directions ($Z_1$);

a ring (43), positioned at the free end (37*a*) of said first stem (37), in which said peg (41) fits passing and kept in position by a mechanical fastening member inserted into an end through hole (44).

24. Assembly (1) as defined in claim 21) characterized in that said second linear actuator (34) includes a completion cylinder (45), provided with a second stem (46) connected by connection means (47) to said upper arms of said first extension arms (4), said second stem (46) being totally within said completion cylinder (45) in said working position and totally outside said completion cylinder (45) in said rest position.

25. Assembly (1) as defined in claim 21) characterized in that said completion cylinder (45) defines a substantially vertical axis (K) in said rest position.

26. Assembly (1) as defined in claim 24) characterized in that said connection means (47) include:

a movable clamp (48) and a fixed clamp (49), spaced from each other and tight around said completion cylinder (45);

a laminar body (50) interposed between said upper arms of said first extension arms (4);

a shaped fork (51), on one side connected to the free end (46*a*) of said second stem (46) of said completion cylinder (45) through bond means (52) and on the other side connected to said laminar body (50) through first guide means (53).

27. Assembly (1) as defined in claim 26) characterized in that said movable clamp (48) is connected to said laminar body (50) through second guide means (54) and said fixed clamp (49) is fixed to said laminar body (50) by first fastening means (55).

28. Assembly (1) as defined in claim 27) characterized in that said fixed clamp (49) is composed by two parallelepiped blocks (60, 61) one maintained close to the other in correspondence of the inner edge through second link means (62) in order to create a close profile circular through hole (63) where said completion cylinder (45) is housed.

29. Assembly (1) as defined in claim 27) characterized in that said movable clamp (48) is composed of two parallelepiped bodies (56, 57) one maintained separate and facing to the other at the inside edge (56*a*, 57*a*) through first link means (58) in order to create an open profile circular through hole (59) where said completion cylinder (45) is housed.

30. Assembly (1) as defined in claim 28) characterized in that one of said parallelepiped bodies (56, 57) and blocks (60, 61) presents on the outer edge (56*c*, 60*c*) a central indentation (64, 65) interposed between two peripheric protuberances (66, 67, 68, 69) opposed and facing each other.

31. Assembly (1) as defined in claim 30) characterized in that said laminar body (50) comprises:

a medial sector (70) which supports said fixed clamp (49) and is provided with a folded section (71) which defines in the rear surface (70*a*) a central cavity (72) having a linear axis (H);

a pair of side wings (73, 74) opposed one another, forming a right angle with said medial sector (70), each of which is fixed to one of the lateral faces (4*b*) one facing to the other of said upper arms.

32. Assembly (1) as defined in to claim 26) characterized in that said shaped fork (51) presents an L-shaped profile in cross section.

33. Assembly (1) as defined in claim 26) characterized in that said shaped fork (51) includes a supporting block (75), which has at one end a central notch (76) which receives said free end (46*a*) of said second stem (46) and is interposed between two side walls (77, 78) opposed and facing one another, and a hooking block (79) having a thickness (s) lower than the thickness (S) of said supporting block (75).

34. Assembly (1) as defined in claim 31) characterized in that said first guide means (53) comprise:

a rear longitudinal track (80), coupled in said central cavity (72) of said medial sector (70) from which protrudes for a lower stretch (80*a*) measured along said linear axis (H);

a first shaped sliding block (81) to which said shaped fork (51) is integral, which slides on said rear longitudinal track (80).

35. Assembly (1) as defined in claim 34) characterized in that in cross section said rear longitudinal track (80) presents a substantially C-shaped profile and said first shaped sliding block (81) presents a substantially Ω-shaped profile.

36. Assembly (1) as defined in claim 33) characterized in that said bond means (52) include a first pin (82) inserted into:

two through holes (83, 84) reciprocally coaxial, each of which made in one of said side walls (77, 78) of said supporting block (75) of said shaped fork (51);

a through hole coaxial to said through holes (83, 84), made in said free end (46*a*) of said second stem (46) along an axis orthogonal to the axis defined by said second stem (46).

37. Assembly (1) as defined in claim 34) characterized in that said first fastening means (55) comprise:

an intermediate rise (86), connected to one of said parallelepiped blocks (60, 61) of said fixed clamp (49) by a second pin inserted into through openings (87, 88) reciprocally coaxial, obtained in said peripheric protuberances (68, 69) of said parallelepiped block (60), and into a through opening, coaxial to said through openings (87, 88), obtained in a projecting portion of said intermediate rise (86) contained in said central indentation (65) of said parallelepiped block (60);

a first shaped insert (89) to which said intermediate rise (86) is integral, steadily conjugate in said rear longitudinal track (80).

38. Assembly (1) as defined in claim 37) characterized in that in cross section said intermediate rise (86) presents an L-shaped profile and said first shaped insert (89) presents a substantially Ω-shaped profile.

39. Assembly (1) as defined in claim 37) characterized in that said second guide means (54) include:

a lower rise (90), connected to one of said parallelepiped bodies (56, 57) of said movable clamp (48) by a third pin inserted into through openings (91, 92) reciprocally coaxial, obtained in said peripheric protuberances (66, 67) of said parallelepiped body (56), and into a through opening (93), coaxial to said through openings (91, 92), obtained in a projecting area (94) of said lower rise (90) contained in said central indentation (64) of said parallelepiped body (56);

a second shaped sliding block (95) to which said lower rise (90) is integral, which slides on said rear longitudinal track (80) in correspondence of said lower stretch (80*a*).

40. Assembly (1) as defined in claim 39) characterized in that said first and second shaped sliding block (81, 95) and said first shaped insert (89) equally protrude from the rear surface (70*a*) of said medial sector (70).

41. Assembly (1) as defined in claim 39) characterized in that in cross section said lower rise (90) presents an L-shaped profile while said second shaped sliding block (95) presents a substantially Ω-shaped profile.

42. Assembly (1) as defined in claim 26) characterized in that it comprises elastic means, arranged around said completion cylinder (45) between said fixed clamp (49) and said movable clamp (48) which supports them, suitable to make elastically yielding said movable clamp (48) along said linear axis (H).

43. Assembly (1) as defined in claim 31) characterized in that said transmission means (35) include:

a cut off chain (96) which has a first end (96*a*) connected to a first support element (97) integral with said shaped fork (51) and a second end (96*b*) connected to a second support element (98) coupled through third guide means (99) with said laminar body (50), at the opposite side of said shaped fork (51);

a pinion (100) on which engages said cut off chain (96), coaxial to said rotating shaft (28) and laterally protruding from one of said inferior arms of said second extension arms (5).

44. Assembly (1) as defined in claim 43) characterized in that said pinion (100) is firmly connected to said second end (5*d*) of one of said inferior arms of said second extension arms (5).

45. Assembly (1) as defined in claim 43) characterized in that said third guide means (99) include:

a front longitudinal track (105), coupled with the anterior surface (70*b*) of said medial sector (70);

a third shaped sliding block (106) which slides on said front longitudinal track (105) and is connected to said second support element (98) by interposing a rise baffle (107).

46. Assembly (1) as defined in claim 43) characterized in that each of said support elements (97, 98) is composed of:

a first bracket (101, 102) provided with a plurality of teeth (103, 104) which extend from the side wall (101*a*, 102*a*) to which said ends (96*a*, 96*b*) of said cut off chain (96) hooks;

a second bracket, fitting with said first bracket (101, 102) with which is permanently coupled through seal means in order to cover said teeth (103, 104) and said ends (96*a*, 96*b*) of said cut off chain (96).

47. Assembly (1) as defined in claim 45) characterized in that said third guide means (99) include a sliding rod (108) which defines a straight direction (J) parallel to said linear axis (H) and along which said third shaped sliding block (106) and said second support element (98) are movable.

48. Assembly (1) as defined in claim 47) characterized in that said sliding rod (108) is fixed at one end (108*a*) to said rise baffle (107) and at the opposite end (108*b*) is provided with an indented coaxial peg (109), having section smaller than the one of said rod (108), which is inserted into a stop small block (110), frontally integral with a second shaped insert (111) steadily conjugate in said front longitudinal track (105).

49. Assembly (1) as defined in claim 48) characterized in that said stop small block (110) and said rise baffle (107) present an L-shaped profile in cross section.

50. Assembly (1) as defined in claim 48) characterized in that said shaped third sliding block (106) and said second shaped insert (111) protrude of the same extent from said anterior surface (70*b*) of said medial sector (70) and present a substantially Ω-shaped profile in cross section.

51. Assembly (1; 200; 300; 400; 500; 600) as defined in claim 1) characterized in that it comprises control means operatively connected to said moving means (3; 201; 301; 401; 501; 601).

* * * * *